US008844608B2

(12) United States Patent
Kimura et al.

(10) Patent No.: US 8,844,608 B2
(45) Date of Patent: Sep. 30, 2014

(54) HEATING AND COOLING UNIT, AND HEATING AND COOLING APPARATUS

(75) Inventors: Keiichi Kimura, Osaka (JP); Mitsuo Morita, Osaka (JP); Kazuyuki Kasahara, Osaka (JP); Katsuhiro Urano, Osaka (JP)

(73) Assignee: Kimura Kohki Co., Ltd., Osaka (JP)

( * ) Notice: Subject to any disclaimer, the term of this patent is extended or adjusted under 35 U.S.C. 154(b) by 999 days.

(21) Appl. No.: 12/758,871

(22) Filed: Apr. 13, 2010

(65) Prior Publication Data

US 2010/0263829 A1 Oct. 21, 2010

(30) Foreign Application Priority Data

| | | |
|---|---|---|
| Apr. 13, 2009 | (JP) | 2009-096725 |
| Jun. 9, 2009 | (JP) | 2009-138717 |
| Jul. 15, 2009 | (JP) | 2009-167201 |
| Dec. 17, 2009 | (JP) | 2009-286684 |
| Jan. 28, 2010 | (JP) | 2010-016962 |

(51) Int. Cl.

| | |
|---|---|
| ***F24F 1/01*** | (2011.01) |
| ***F24F 5/00*** | (2006.01) |
| *F24F 1/00* | (2011.01) |

(52) U.S. Cl.

CPC ..... *F24F 5/0089* (2013.01); *F24F 2221/14* (2013.01); *F24F 1/01* (2013.01); *F24F 2001/0062* (2013.01); *F24F 5/0092* (2013.01)

USPC ..... 165/10; 165/53; 165/54; 165/55; 165/57; 165/122; 165/123; 165/236; 454/264

(58) Field of Classification Search

CPC ..... F24F 2001/0062; F24F 2221/14; F24F 1/01; F24F 5/0089; F24F 5/0092

USPC ..... 165/122, 123, 236, 48.1, 53, 57, 54, 10, 165/55; 454/264

See application file for complete search history.

(56) References Cited

U.S. PATENT DOCUMENTS

| | | | | |
|---|---|---|---|---|
| 2,144,466 | A * | 1/1939 | Stikeleather | 165/123 |
| 2,205,716 | A * | 6/1940 | Dunham et al. | 165/122 |
| 2,442,963 | A * | 6/1948 | Sewell et al. | 454/264 |
| 3,823,870 | A | 7/1974 | Chandler | |
| 3,998,267 | A * | 12/1976 | Faiczak | 165/236 |
| 4,281,522 | A | 8/1981 | Bussjager | |
| 5,097,674 | A | 3/1992 | Imaiida et al. | |
| 6,569,010 | B1 | 5/2003 | Miller et al. | |
| 2006/0211365 | A1 | 9/2006 | Petrovic | |
| 2008/0283621 | A1 | 11/2008 | Quirino et al. | |

FOREIGN PATENT DOCUMENTS

| | | | |
|---|---|---|---|
| CN | 1759279 | A | 4/2006 |
| DE | 36 44 590 | A1 | 7/1988 |
| EP | 1 188 992 | A2 | 3/2002 |
| EP | 1 319 902 | A1 | 6/2003 |

(Continued)

*Primary Examiner* — John Ford

(74) *Attorney, Agent, or Firm* — Muncy, Geissler, Olds & Lowe, P.C.

(57) ABSTRACT

In an induction emission air conditioning apparatus installed in a ceiling, it is provided within a casing with a heat exchanger through which a feed air introduced from an outdoor side passes, a fan passing the feed air through the air conditioning heat exchanger, and a heating and cooling unit 1 for blowing a mixed air obtained by inducing and suctioning the air in the room inside by using the feed air passing through the heat exchanger so as to mix with the feed air, into the room inside in a laminar manner, and emitting the heat of the mixed air to the room inside, integrally.

14 Claims, 24 Drawing Sheets

S

(56) References Cited

FOREIGN PATENT DOCUMENTS

| | | | |
|---|---|---|---|
| EP | 2 023 051 | A2 | 2/2009 |
| FR | 1 545 745 | | 11/1968 |
| GB | 2 349 688 | A | 11/2000 |
| JP | 60-28335 | | 2/1985 |
| JP | 62-192169 | | 12/1987 |
| JP | 63-700 | | 1/1988 |
| JP | 2078850 | | 3/1990 |
| JP | 5-052366 | | 3/1993 |
| JP | 07-0195333 | | 1/1995 |
| JP | 11-201501 | | 7/1999 |
| JP | 2000-121167 | | 4/2000 |
| JP | 2001-304653 | | 10/2001 |
| JP | 2005-061686 | | 3/2005 |
| JP | 2005-315462 | | 11/2005 |
| JP | 2007-225199 | | 9/2007 |
| JP | 2009-36409 | | 2/2009 |
| WO | WO 95/19528 | A1 | 7/1995 |
| WO | WO 98/38458 | | 9/1998 |
| WO | WO 03/102484 | A2 | 12/2003 |
| WO | WO 2008/119893 | A1 | 10/2008 |

* cited by examiner

HEATING AND COOLING UNIT, AND HEATING AND COOLING APPARATUS

CROSS-REFERENCE TO RELATED APPLICATION (US only) This Nonprovisional application claims priority under 35 U.S.C. §119(a) on Patent Application No. 2009-096725 filed in Japan on Apr. 13, 2009, Patent Application No. 2009-138717 filed in Japan on Jun. 9, 2009, Patent Application No. 2009-167201 filed in Japan on Jul. 15, 2009, Patent Application No. 2009-286684 filed in Japan on Dec. 17, 2009, Patent Application No. 2010-016962 filed in Japan on Jan. 28, 2010, the entire contents of which are hereby incorporated by reference.

BACKGROUND

1. Technical Field

The present invention relates to a heating and cooling unit and a heating and cooling apparatus for adjusting the temperature of feed air to be fed and supplying air to the room inside.

2. Description of Related Art

A heating and cooling apparatus for carrying out comfortable heating and cooling by, for example, burying a heating and cooling unit provided with a radiation panel, in which a plurality of pipes for letting heating medium or cooling medium through are installed, in the ceiling and carrying out radiation heating or radiation cooling is in widespread use instead of a conventional heating and cooling apparatus (e.g., a multi air conditioner or a fan coil unit) for blowing cold air or warm air directly to the room inside.

For example, disclosed in Patent Literature 1 is a ceiling heating-cooling radiation panel comprising: a pipe support part, which is formed to be integrated with a radiation panel body and in which a pipe for letting temperature medium through can be fitted from the thickness direction of the radiation panel body; and a pipe screw member, which is engaged with the pipe support part to fix the pipe for letting temperature medium through, whereby attachment of the pipe for letting temperature medium through can be facilitated and replacement of the pipe for letting temperature medium through can be carried out easily even after installation thereof. (refer to Japanese Patent Application Laid-Open No. H7-19533 (1995)).

SUMMARY

On the other hand, a heating and cooling apparatus such as a multi air conditioner or a fan coil unit described above has a problem that the wind velocity of cold air or warm air from an indoor equipment installed at the room inside is too high, and causes the user of the room inside to feel a draft and tends to cause temperature unevenness at the room inside.

Moreover, the air conditioning efficiency of the heating and cooling apparatus described above, which uses radiation cooling or radiation heating, is low since only low heat or high heat due to radiation cooling or radiation heating is employed therein, and the range of use of the heating and cooling apparatus is limited. For example, it is not appropriate to use the heating and cooling apparatus in a place having poor thermal insulation properties, a place having a large thermal load, or a place having much air flowing into and out thereof. Moreover, there is another problem that it is necessary to provide measures against dew condensation or the like separately, which causes cost increase.

However, the ceiling heating-cooling radiation panel of the Patent Literature 1 cannot resolve the above problems.

The present invention has been made in view of such a situation, and an object thereof is to provide a heating and cooling unit and a heating and cooling apparatus in which since supplying mixed air which is obtained by mixing feed air to be fed and circulated air from the room inside, to the room inside in a laminar manner, and emitting heat obtaining from the mixed air, to the room inside so as to carry out an air conditioning of the room inside, it becomes to possible to get high efficiency and high power, to reduce a space unsuitable for air conditioning than air conditioning by the conventional radiation panel employing only heat emission, to prevent a draft and temperature unevenness, to expand the range of usage of the apparatus, and to avoid the need of a measures against dew condensation.

A heating and cooling unit according to the present invention is characterized by comprising: a mixer case for supplying mixed air, which is obtained by mixing circulated air from the room inside with feed air to be fed, to the room inside; a guide path, which is communicatively connected with the circulated air, for guiding the feed air to the mixer case; and a heat storage radiation member, which is attached in the mixer case in a thermally-conductive manner, for obtaining heat from the mixed air and radiating the heat to the room inside.

In the present invention, feed air to be fed is blown through the guide path to the mixer case. In such a manner, the circulated air flows through the guide path into the mixer case and is mixed with the feed air to become mixed air. The heat storage radiation member obtains low heat or high heat from the mixed air and carries out radiation cooling or radiation heating to the room inside.

A heating and cooling unit according to the present invention is characterized by comprising: an adjustment case for adjusting the flow of the feed air; and a box member, which has an opening at one face thereof and is buried in a wall at the room inside with said one face facing the room inside, for housing the adjustment case, the mixer case and the guide path, wherein a circulated air path communicatively connecting from the opening to the guide path is formed inside said box member.

In the present invention, the box member houses therein the adjustment case, the mixer case and the guide path, and the circulated air path is further formed. Circulated air enters the box member via the opening, travels through the circulated air path and the guide path, and flows into the mixer case.

A heating and cooling unit according to the present invention is characterized in that the heat storage radiation member comprises a plurality of juxtaposed flow dividing fins for dividing the flow of mixed air to be supplied to the room inside and letting the mixed air through.

In the present invention, the flow of mixed air to be supplied to the room inside is divided into a plurality of layers by the flow dividing fins of the heat storage radiation member, and the mixed air is supplied to the room inside in a so-called multi-layer flow manner, and therefore the draft to be given to the user of the room inside is suppressed.

A heating and cooling unit according to the present invention is characterized in that the heat storage radiation member comprises an elliptical heat storage pipe penetrating the plurality of flow dividing fins in a juxtaposition direction of the flow dividing fins.

In the present invention, since the heat storage pipe has an elliptical shape, a pressure loss to be caused by collision between the mixed air and the heat storage pipe while the mixed air passes the heat storage radiation member and is fed to the room inside can be reduced, and the mixed air passes the heat storage radiation member smoothly and is supplied to the room inside. Moreover, the heat storage pipe strengthens the flow dividing fins and radiates heat, which is obtained from the mixed air and stored, to the room inside.

A heating and cooling unit according to the present invention is characterized by comprising a plurality of short tubular protrusions, which are formed to protrude from a face of the flow dividing fins, for changing the direction of radiation heating toward the room inside and dividing the flow of the mixed air.

In the present invention; the short tubular protrusions change the direction of radiation heating toward the room inside and further divide the flow of mixed air to be supplied to the room inside. Moreover, since the protrusions come into contact with the mixed air at this time, heat is obtained from the mixed air and transferred not only by the flow dividing fins but also by the protrusions more uniformly over the entire area of the heat storage radiation member, and occurrence of temperature unevenness in radiation heating to the room inside and in supply of mixed air is inhibited.

A heating and cooling unit according to the present invention is characterized in that the protrusions are juxtaposed in the longitudinal direction of the flow dividing fins so as to reach or almost reach adjacent flow dividing fins, the mixer case comprises an aperture face, which has an aperture where mixed air to be supplied to the room inside passes and faces said room inside, and the aperture is positioned below the protrusions.

In the present invention, the flow of mixed air in the mixer case is divided by the protrusions and the mixed air passes the aperture of the aperture face positioned below the protrusions and enters the room inside through the opening. Moreover, the direction of radiation heat from the mixed air is changed by the protrusions and the radiation heat passes the aperture of the aperture face and enters the room inside through the opening.

A heating and cooling unit according to the present invention is characterized in that the box member has a flat shape, the mixer case has a flat box shape, the circulated air path is formed at the outer side of one face opposed to the aperture face and the outer side of any two opposed side faces adjacent to the aperture face, a rectangular air suction port for suctioning adjusted air from the adjustment case and circulated air from the room inside is provided at the midpoint between the two opposed side faces on the one face of the mixer case, the adjustment case comprises a rectangular air blowoff port for blowing out the adjusted air, and said air blowoff port is located to be matched with the air suction port of the mixer case.

In the present invention, adjusted air in the adjustment case is blown out from the air blowoff port and suctioned into the air suction port at a position matched with the air blowoff port. In such a manner, circulated air from the room inside is suctioned together from the circulated air path, which is formed at the outer side of the one face of the mixer case and the outer side of the two opposed side faces, and is mixed in the mixer case.

A heating and cooling unit according to the present invention is characterized in that the adjustment case is a box member which narrows toward the air blowoff port.

In the present invention wherein the adjustment case is a box member which narrows toward the air blowoff port, the wind direction, the air pressure (wind pressure) and the like are adjusted due to collision with the inner face of the adjustment case or the like before blowing out of feed air from the air blowoff port, and the feed air is blown out from the air blowoff port as the adjusted air.

A heating and cooling unit according to the present invention is characterized in that the air blowoff port or the air suction port is constructed to be able to adjust the volume of air passing through.

In the present invention, the volume of adjusted air to be blown out from the air blowoff port of the adjustment case and the volume of the adjusted air and circulated air to be suctioned into the air suction port of the mixer case can be respectively adjusted as occasion arises.

A heating and cooling unit according to the present invention is characterized in that a pair of an air blowoff port door member and a pair of an air suction port door member for adjusting the volume of air to pass the air blowoff port or the air suction port are respectively attached to edge parts of both long sides of the air blowoff port or the air suction port so as to be slidable.

In the present invention, the volume of adjusted air to be blown out from the air blowoff port of the adjustment case is adjusted by opening or closing the air blowoff port door member, and the volume of the adjusted air and circulated air to be suctioned into the air suction port of the mixer case is adjusted by opening or closing the air suction port door member.

A heating and cooling unit according to the present invention is characterized in that the guide path includes a part of each of the air blowoff port door member and the air suction port door member, and the air blowoff port door member and the air suction port door member are located at opposed positions across a space.

In the present invention wherein the air blowoff port door member and the air suction port door member are located at opposed positions across a space, and the air pressure lowers at the periphery of the guide path while the adjusted air flows from the air blowoff port door member (air blowoff port) into the air suction port door member (air suction port), and air at the periphery of the guide path (circulated air) is suctioned into the air suction port door member (air suction port) through the guide path.

A heating and cooling unit according to the present invention is characterized in that a guiding piece for guiding the feed air to the air blowoff port is provided inside the adjustment case.

In the present invention, when the feed air is fed to the adjustment case, the feed air collides with the guiding piece inside the adjustment case, the wind direction thereof is changed, and the feed air is guided to the air blowoff port.

A heating and cooling unit according to the present invention is characterized in that the adjustment case comprises: an inlet for receiving the feed air; and a suppression structure for suppressing occurrence of ununiformity in the wind pressure and the wind velocity of feed air in the adjustment case depending on the distance from said inlet.

In the present invention, the suppression structure suppresses occurrence of ununiformity in the wind pressure and the wind velocity in the adjustment case, such as occurrence of unevenness in the distribution of feed air in the adjustment case, depending on the distance from the inlet, that is, from the windward side in the vicinity of the inlet to the leeward side.

A heating and cooling unit according to the present invention, is characterized in that the suppression structure is a rectangular plate material, which is located to be opposed to the air blowoff port in a manner such that the distance from said air blowoff port gradually increases or decreases along the longitudinal direction of the air blowoff port, and the inlet is formed at one end side of the suppression structure where the distance is the largest.

In the present invention which is constructed in a manner such that the distance between the suppression structure and the air blowoff port is the largest at the inlet side and gradually decreases along the longitudinal direction of the air blowoff port, the suppression structure suppresses decrease in air distribution depending on the distance from the inlet, that is, occurrence of a difference in, for example, the wind pressure or the wind velocity with the distance from the inlet in the adjustment case.

A heating and cooling unit according to the present invention is characterized in that a heat storage member for obtaining heat from the mixed air and storing the heat is filled in the heat storage pipe.

In the present invention, the heat storage pipe (heat storage member) obtains heat from the mixed air and stores the heat. The stored heat is radiated to the room inside via the opening of the box member.

A heating and cooling unit according to the present invention is characterized in that the aperture face of the mixer case has an area smaller than the opening of the box member, a passage clearance where circulated air to be suctioned into the circulated air path passes is formed between an edge of the opening of the box member and an edge of the aperture face, and a lighting system for lighting the room inside is provided at said passage clearance in a manner such that the circulated air can pass.

In the present invention, the lighting system provided at the passage clearance lights the room inside. At this time, heat emitted by the lighting system is given to circulated air to be suctioned into the circulated air path so as to be used for reheating or preheating in mixing of the feed air and circulated air.

The present invention provides a heating and cooling apparatus supplying mixed air which is obtained by mixing feed air to be fed with circulated air from the room inside, to the room inside, characterized by comprising a heat exchanger, a fan passing the feed air to the heat exchanger, and a heating and cooling unit rectifying the mixed air of the feed air passing through the heat exchanger and being treated, and the circulated air so as to supply to the room inside, and emitting the heat of the mixed air to the room inside.

In the present invention, the feed air is passed through the heat exchanger by the fan, and the feed air is heat exchanged at this time. The feed air after being treated and passing through the heat exchanger so as to be heat exchanged as mentioned above is mixed with the circulated air in the heating and cooling unit so as to become the mixed air, and the mixed air is rectified so as to be fed to the room inside. Further, the heating and cooling unit obtains the heat from the mixed air, and emits the heat to the room inside.

The heating and cooling apparatus according to the present invention is characterized by comprising a mixer case mixing the feed air after being treated with the circulated air, and being structured so as to induce and suction the circulated air into the mixer case by using the feed air after being treated.

In the present invention, the feed air after being treated and the circulated air are mixed in the mixer case of the heating and cooling unit. Further, the heating and cooling unit induces and suctions the circulated air into the mixer case, for example, by using a reduction of an air pressure generated in the vicinity of the feed air when the feed air after being treated flows.

The heating and cooling apparatus according to the present invention is characterized in that the heating and cooling unit is formed into a rectangular parallelepiped shape, the heat exchanger and the fan are respectively arranged in both sides of the heating and cooling unit sandwiched therebetween, and an air blowing path communicatively connecting the heat exchanger, the fan and the heating and cooling unit is provided.

According to the present invention, a reduction of noise caused by an elongation of a moving distance is achieved by moving the feed air after being treated passing through the heat exchanger in one side of the heating and cooling unit to the fan in the other side of the heating and cooling unit along the air blowing path.

A heating and cooling apparatus according to the present invention is characterized in that the heating and cooling unit is formed into a rectangular parallelepiped shape, the heat exchanger and the fan are arranged in a face side of the heating and cooling unit, and a air blowing path communicatively connecting the heat exchanger, the fan and the heating and cooling unit is provided.

In the present invention, since the heat exchanger and the fan are arranged in a face side of the heating and cooling unit, to shorten the air blowing path, and it is possible to achieve a compact structure of the apparatus.

A heating and cooling apparatus according to the present invention is characterized by comprising a casing housing the heat exchanger, the fan and the heating and cooling unit, the casing being provided with an opening part facing to the room inside, and the opening part being provided with a lighting system so as to freely open and close or be detachable.

In the present invention; the lighting system is provided in the opening part facing to the room inside of the casing so as to freely open and close or be detachable, and a user does maintenance by detaching the lighting system as occasion demands, or does maintenance on the inner side of the apparatus via the opening part.

A heating and cooling apparatus according to the present invention is characterized by comprising a detector detecting a human body in the room inside, and a controller controlling one or both of an air conditioning performance and the light modulation of the lighting-system, based on a detection result of the detector.

In the present invention, the controller carries out, any one or both of a control of the air conditioning performance such as increase/decrease of air volume, blowoff temperature and the like or turning on and off thereof, and a control of the light modulation of the lighting system such as increase/decrease of lighting intensity or turning on and off thereof, based on the detection result of the detector.

A heating and cooling apparatus according to the present invention is characterized by comprising a casing housing the heat exchanger, the fan and the heating and cooling unit, the casing being provided with an opening part facing to the room inside, and the opening part being provided with a maintenance and inspection panel so as to freely open and close or be detachable.

In the present invention, the maintenance and inspection panel is provided in the opening part facing to the room inside of the casing so as to freely open and close or be detachable, and a user does maintenance by detaching the maintenance and inspection panel as occasion demands.

A heating and cooling apparatus according to the present invention is characterized by comprising a detector detecting a human body in the room inside, and a controller controlling an air conditioning performance based on a detection result of the detector.

In the present invention, the controller carries out a control of an air conditioning performance, for example, increase/decrease of air volume, blowoff temperature and the like, or turning on and off thereof, based on the detection result of the detector.

A heating and cooling apparatus according to the present invention is characterized in that a heat transfer pipe of the heat exchanger is an elliptical pipe.

In the present invention, it is possible to reduce a pressure loss to be caused by collision between the feed air and the heat transfer pipe while the feed air passes through the heat exchanger, and the feed air passes through the heat exchanger smoothly.

A heating and cooling apparatus according to the present invention is characterized in that the casing is provided in a ceiling of the room inside, and is structured such that the air in a back side of the ceiling is used as the feed air, and said air passes through the heat exchanger.

In the present invention, the air in the back side of the ceiling is passed through the heat exchanger by the fan, and the air in the back side of the ceiling is heat exchanged at this time.

A heating and cooling apparatus according to the present invention is characterized in that the heating and cooling unit is provided with a guide path which is communicatively connected with the circulated air, for guiding the feed air to the mixer case, and a heat storage radiation member, which is attached in the mixer case in a thermally-conductive manner, for obtaining heat from the mixed air, and radiating the heat to the room inside.

In the present invention, the feed air is blown through the guide path to the mixer case. In such a manner, the circulated air is induced and suctioned, flows into the mixer case through the guide path, is mixed with the feed air, and becomes the mixed air. The heat storage radiation member obtains low heat or high heat from the mixed air and carries out radiation cooling or radiation heating to the room inside.

A heating and cooling apparatus according to the present invention is characterized in that the heating and cooling unit is provided with an adjustment case for adjusting the flow of the feed air after being treated, and a box member, which is housed in the casing, has an opening in the opening part side of the casing, and houses the adjustment case, the mixer case and the guide path, and a circulated air path communicatively connecting the opening to the guide path is formed inside the box member.

In the present invention, the box member houses therein the adjustment case, the mixer case and the guide path, and the circulated air path is further formed. Circulated air enters the box member via the opening, travels through the circulated air path and the guide path, and flows into the mixer case.

A heating and cooling apparatus according to the present invention is characterized in that the heat storage radiation member is provided with a plurality of juxtaposed flow dividing fins for dividing flow of mixed air to be supplied to the room inside and letting the mixed air through.

In the present invention, the flow of mixed air to be supplied to the room inside is divided into a plurality of layers by the flow dividing fins of the heat storage radiation member, and the mixed air is supplied to the room inside in a so-called laminar manner, and therefore the draft to be given to the user of the room inside is suppressed.

A heating and cooling apparatus according to the present invention is characterized in that the heat storage radiation member comprises an elliptical heat storage pipe penetrating the plurality of flow dividing fins in a juxtaposition direction of the flow dividing fins.

In the present invention, since the heat storage pipe has an elliptical shape, a pressure loss to be caused by collision between the mixed air and the heat storage pipe while the mixed air passes the heat storage radiation member and is fed to the room inside can be reduced, and the mixed air passes the heat storage radiation member smoothly and is supplied to the room inside. Moreover, the heat storage pipe strengthens the plurality of flow dividing fins and radiates heat, which is obtained from the mixed air and stored, to the room inside.

A heating and cooling apparatus according to the present invention is characterized in that the heating and cooling unit is provided with a plurality of short tubular protrusions, which are formed to protrude from a face of the flow dividing fins, for changing the direction of radiation heating toward the room inside and dividing the flow of the mixed air.

In the present invention, the short tubular protrusions change the direction of radiation heating toward the room inside and further divide the flow of mixed air to be supplied to the room inside. Moreover, since the protrusions come into contact with the mixed air at this time, heat is obtained from the mixed air and transferred not only by the flow dividing fins but also by the protrusions more uniformly over the entire area of the heat storage radiation member, and occurrence of temperature unevenness in radiation heating to the room inside and in supply of mixed air is inhibited.

A heating and cooling apparatus according to the present invention is characterized in that the protrusions are juxtaposed in the longitudinal direction of the flow dividing fins so as to reach or almost reach adjacent flow dividing fins, the mixer case comprises an aperture face, which has an aperture where mixed air to be supplied to the room inside passes and faces said room inside, and the aperture is positioned below the protrusions.

In the present invention, the flow of mixed air in the mixer case is divided by the protrusions and the mixed air passes the aperture of the aperture face positioned below the protrusions and enters the room inside through the opening. Moreover, the direction of radiation heat from the mixed air is changed by the protrusions and the radiation heat passes the aperture of the aperture face and enters the room inside through the opening.

A heating and cooling apparatus according to the present invention is characterized in that the box member has a flat shape, the mixer case has a flat box shape, the circulated air path is formed at the outer side of one face opposed to the aperture face of the mixer case and the outer side of any two opposed side faces adjacent to the aperture face, a rectangular air suction port for suctioning adjusted air from the adjustment case and circulated air from the room inside is provided at the midpoint between the two opposed side faces on the one face of the mixer case, the adjustment case comprises a rectangular air blowoff port for blowing out the adjusted air, and said air blowoff port is located to be matched with the air suction port of the mixer case.

In the present invention, adjusted air in the adjustment case is blown out from the air blowoff port and suctioned into the air suction port at a position matched with the air blowoff port. In such a manner, circulated air is suctioned together from the circulated air path, which is formed at the outer side of the one face of the mixer case and the outer side of the two opposed side faces, and is mixed in the mixer case.

A heating and cooling apparatus according to the present invention is characterized in that the adjustment case is a box member which narrows toward the air blowoff port.

In the present invention wherein the adjustment case is a box member which narrows toward the air blowoff port, the wind direction, the air pressure (wind pressure) and the like are adjusted due to collision with the inner face of the adjustment case or the like before blowing out of feed air from the air blowoff port, and the feed air is blown out from the air blowoff port as the adjusted air.

A heating and cooling apparatus according to the present invention is characterized in that a pair of an air blowoff port door member and a pair of an air suction port door member for adjusting the volume of air to pass the air blowoff port or the air suction port are respectively attached to edge parts of both long sides of the air blowoff port or the air suction port so as to be slidable.

In the present invention, the volume of adjusted air to be blown out from the air blowoff port of the adjustment case is adjusted by opening or closing the air blowoff port door member, and the volume of the adjusted air and circulated air to be suctioned into the air suction port of the mixer case is adjusted by opening or closing the air suction port door member.

A heating and cooling apparatus according to the present invention is characterized in that the guide path has a part of each of the air blowoff port door member and the air suction port door member, and the air blowoff port door member and the air suction port door member are located at opposed positions across a space.

In the present invention wherein the air blowoff port door member and the air suction port door member are located at opposed positions across a space, and the air pressure lowers at the periphery of the guide path while the adjusted air flows from the air blowoff port door member (air blowoff port) into the air suction port door member (air suction port), and air at the periphery of the guide path (circulated air) is suctioned into the air suction port door member (air suction port) through the guide path.

A heating and cooling apparatus according to the present invention is characterized in that a guiding piece for guiding the feed air after being treated to the air blowoff port is provided inside the adjustment case.

In the present invention, when the feed air is fed to the adjustment case, the feed air collides with the guiding piece inside the adjustment case, the wind direction thereof is changed, and the feed air is guided to the air blowoff port.

A heating and cooling apparatus according to the present invention is characterized in that the adjustment case is provided with an inlet which is communicatively connected with the air blowing path and receives the feed air after being treated, and a suppression structure of a rectangular plate member which is arranged so as to be opposed to the air blowoff port in a manner such that a distance from the air blowoff port gradually increases or decreases along a longitudinal direction of the air blowoff port, and the inlet is formed in one end side of the suppression structure where the distance is the largest.

In the present invention which is constructed in a manner such that the distance between the suppression structure and the air blowoff port is the largest at the inlet side and gradually decreases along the longitudinal direction of the air blowoff port, the suppression structure suppresses occurrence of a difference in the wind pressure and the wind velocity of feed air in the adjustment case, depending on the distance from the inlet, that is, from the windward side in the vicinity of the inlet to the leeward side A heating and cooling apparatus according to the present invention is characterized in that the air blowing path is constructed so as to be used as a humidification space for humidifying the feed air after being treated.

In the present invention, the feed air after being treated passing through the air blowing path is humidified by the humidification space, and flows into the adjustment case via the inlet of the adjustment case.

With the heating and cooling unit according to the present invention, circulated air, which is made to enter the mixer case through the guide path due to decreasing air pressure at the periphery of the guide path, and the feed air are mixed in the mixer case and supplied to the room inside while the feed air flows into the mixer case, and therefore it is possible to control the dew point and to forgo a drain treatment equipment for measures against dew condensation so as to reduce the cost. Moreover, it is possible to reduce the cost by reduction of blast power and downsizing of equipments such as a duct by increasing the cooling capacity or the heating capacity per unit air volume of feed air (lowering or raising the air supply temperature than usual) so as to decrease the air supply volume.

Moreover, since radiation cooling or radiation heating to the room inside is carried out from the heat storage radiation member and the mixer case, which is thermally conducted via the heat storage radiation member, it is possible to allow radiation heat (low heat or high heat) to reach a long-distance point with high efficiency, to suppress occurrence of temperature unevenness at the room inside, which is a space to be adjusted, so as to uniform the temperature distribution, to forgo a heat source of heat medium because of obtaining heat from the mixed air, to eliminate the possibility of leakage of medium to occur when heat medium is used, and to simplify the equipments.

With the heating and cooling unit according to the present invention, since circulated air is further suctioned from the room inside when circulated air in the circulated air path is suctioned via the guide path into the mixer case and the air pressure in the circulated air path lowers, such a structure functions as a so-called circulator and therefore it is unnecessary to provide a device for feeding the circulated air to the mixer case separately and it is possible to reduce the operating cost.

It is to be noted that the present invention carries out heat emission to the room inside from the heat storage radiation member via the opening as well as heat emission from the mixer case while a conventional radiation panel carries out only heat emission from the panel face, and therefore radiation (emission) energy can reach a long-distance point at a high rate. The temperature distribution of air at the room inside is uniformed due to synergetic effect of; the above long-distance radiation action; a heat transfer action to a long-distance point and to a wide area caused by decreasing the temperature difference between the room inside and the mixed air so as to prevent the mixed air from remaining close to the ceiling and emitting the mixed air in a laminar manner; and a circulator action to be caused by suctioning (induction) the circulated air, and comfortable air conditioning with high efficiency and high power can be achieved without the draft and temperature unevenness. Accordingly, space unsuitable for air conditioning is less than air conditioning employing only heat emission, and the present invention can be used more extensively.

With the heating and cooling unit according to the present invention, it is possible to suppress the draft to be given to the user of the room inside and to further uniform the temperature distribution at the room inside by dividing the flow of the mixed air and supplying the mixed air to the room inside in a laminar manner. Moreover, it is possible to transfer heat of mixed air efficiently and reliably to the entire area of the heat storage radiation member by the flow dividing fins and storage the heat, to conduct heat uniformly to the mixer case, and to always carry out stable heat emission.

With the heating and cooling unit according to the present invention, the heat storage pipe radiates heat obtained from the mixed air to the room inside and functions as a strengthening member. Moreover, the heat storage pipe can prevent occurrence of deformation such as warping of the flow dividing fins or the heat storage radiation member, and the mixed air can smoothly pass the heat storage radiation member with a low pressure loss in feed of the mixed air, which has passed the heat storage radiation member, to the room inside.

With the heating and cooling unit according to the present invention wherein a plurality of short tubular protrusions formed to protrude from a face of the flow dividing fins change the direction of radiation heating toward the room inside and the flow of mixed air to be supplied to the room inside is further divided, heat from the mixed air is obtained and transferred by contact between the protrusions and the mixed air further uniformly over the entire area of the heat storage radiation member, occurrence of unevenness in radiation heating to the room inside and in supply of mixed air is inhibited, and temperature unevenness at the room inside can be suppressed.

With the heating and cooling unit according to the present invention, a row of the protrusions of the flow dividing fins are positioned above the aperture of the mixer case so as to obstruct the aperture, flow division of mixed air in the longitudinal direction of the flow dividing fins is prompted, bypass (go by) to the aperture can be prevented reliably, and heat of mixed air can be transferred uniformly throughout the entire area of the heat storage radiation member. Moreover, since heat is also emitted obliquely downward from the flow dividing fins through the aperture of the mixer case to the room inside by the protrusions, the radiation (emission) energy can reach a wide area, the temperature distribution of air at the room inside is further uniformed, and comfortable air conditioning without temperature unevenness is achieved.

With the heating and cooling unit according to the present invention wherein mixed air is delivered along a central part of the mixer case and blown to the room inside through the heat storage radiation member, the flow of mixed air is divided reliably and the mixed air is made to flow in a laminar manner throughout the entire area of the heat storage radiation member without uneven distribution or bypass, heat can be conducted uniformly throughout the entire area of the mixer case, an effective air conditioning area per a unit is wide, and the air conditioning efficiency can be enhanced. Moreover, the box member, which has a flat shape, can be installed easily even in a narrow ceiling, for example. Furthermore, only one air blowoff port is required for the adjustment case, and therefore the structure can be simplified and manufacturing can be facilitated.

With the heating and cooling unit according to the present invention, unevenness in the air volume and the wind velocity of adjusted air to be blown out from the air blowoff port can be suppressed over the entire face of the air blowoff port, the volume of circulated air to be suctioned via the guide path into the mixer case due to decreasing air pressure at the periphery of the guide path while the adjusted air flows from the adjustment case into the mixer case also becomes constant, and stable heating and cooling effect can be produced.

With the heating and cooling unit according to the present invention wherein the volume of the adjusted air to pass the air blowoff port or the air suction port can be adjusted, the ratio of the adjusted air and circulated air in supply of the mixed air can be adjusted, and the air volume and the wind velocity of mixed air to be fed to the room inside can be changed as occasion arises.

With the heating and cooling unit according to the present invention wherein a pair of an air blowoff port door member and a pair of an air suction port door member for adjusting the volume of the adjusted air to pass the air blowoff port or the air suction port are respectively attached to edge parts of both long sides of the rectangular air blowoff port or the rectangular air suction port, the volume of the adjusted air to pass the air blowoff port or the air suction port can be adjusted, the ratio of the adjusted air and circulated air in supply of the mixed air can be adjusted, and the air volume and the wind velocity of mixed air to be fed to the room inside can be changed as occasion arises.

With the heating and cooling unit according to the present invention wherein circulated air in the circulated air path is suctioned into the mixer case through the space between the air blowoff port door member and the air suction port door member while the adjusted air flows from the adjustment case into the mixer case, it is unnecessary to provide a device for feeding the circulated air to the mixer case separately, and it is possible to reduce the operating cost.

With the heating and cooling unit according to the present invention wherein the adjustment case comprises a guiding piece for guiding the feed air to the air blowoff port, unevenness in the air volume and the wind velocity of adjusted air to be blown out from the air blowoff port can be suppressed over the entire face of the rectangular air blowoff port.

With the heating and cooling unit according to the present invention, it is possible to prevent occurrence of unevenness in the wind pressure and the wind velocity depending on the distance from the inlet in the adjustment case and to suppress ununiformity in the wind pressure and the wind velocity of adjusted air to be blown from the air blowoff port.

With the heating and cooling unit according to the present invention wherein the inner space of the adjustment case is downsized from the windward side to the leeward side in the longitudinal direction of the air blowoff port, the wind pressure and the wind velocity can be uniformed over the entire area in the longitudinal direction of the air blowoff port and ununiformity does not arise. Accordingly, unevenness does not arise in suction of circulated air, the circulation effect is enhanced, circulated air and adjusted air can be mixed evenly, temperature unevenness does not arise in air to be emitted from the mixer case, and stable air conditioning can be achieved.

With the heating and cooling unit according to the present invention wherein a heat storage member for obtaining heat from the mixed air and storing the heat is filled in the heat storage pipe, it is possible to uniform the heat distribution all over the heat storage radiation member, and to produce further stable' heating and cooling effect including less temperature unevenness at the room inside.

With the heating and cooling unit according to the present invention, it is unnecessary to provide an installation space for providing the lighting device separately, the degree of freedom in designing is enhanced by using the ceiling face widely when the heating and cooling unit is installed in a ceiling face, and the cost of equipments for installation of the lighting system can be reduced. Moreover, when the cooling capacity per unit air volume of the feed air is enlarged (when the air supply temperature is lowered than usual), heat from the lighting system is used for reheating of feed air and therefore it is possible to prevent dew condensation reliably and to further reduce the cost by further decreasing the air supply volume. Moreover, at the time of heating, the capacity of a device for feeding the feed air can be lowered and the heating capacity can be enhanced by using heat of the lighting system for preheating of feed air.

With the heating and cooling apparatus according to the present invention, comfortable air conditioning with high efficiency and high power can be achieved without the draft and temperature unevenness, due to the heat emission (radiation) and the laminar mixed air supplying. Accordingly, the space unsuitable for the air conditioning is less than the air conditioning by the conventional radiation panel employing only heat emission, and the range of use of the apparatus is wide.

With the heating and cooling apparatus according to the present invention, since the air in the room inside corresponding to the space to be air conditioned is induced and suctioned so as to be reheated, it is possible to prevent the dew condensation at a time of cooling, and an energy saving and a cost saving can be achieved.

With the heating and cooling apparatus according to the present invention, since all the functions are put together and integrated into the apparatus, it is easy to install, and it is possible to achieve a space saving.

With the heating and cooling apparatus according to the present invention, since it is possible to individually control the air conditioning performance per apparatus, it is possible to deal with a dispersion of the heat load at the window side and the like, and to carry out the comfortable air conditioning.

With the heating and cooling apparatus according to the present invention, it is possible to utilize various systems such as cold/hot water, a heat pump as a heat source of the heat exchanger.

With the heating and cooling apparatus according to the present invention, it is possible to use the space inside the casing more effectively so as to achieve a compact structure of the entire apparatus.

With the heating and cooling apparatus according to the present invention, since it is possible to keep the air blowing distance within the apparatus long, it is possible to reduce a noise energy, and to improve quietness and comfortableness.

With the heating and cooling apparatus according to the present invention, it is unnecessary to provide the installation space for the lighting system separately, for example, in the case that the heating and cooling apparatus is installed in the ceiling face, the degree of freedom in designing is enhanced by using the ceiling face widely, and the cost of equipments for installation of the lighting system can be reduced. Moreover, when the cooling capacity per unit air volume of the feed air is enlarged (when the air supply temperature is lowered than usual), heat from the lighting system is used for reheating of feed air and therefore it is possible to prevent dew condensation reliably and to further reduce the cost by further decreasing the air supply volume. Moreover, at the time of heating, the capacity of a device for feeding the feed air can be lowered and the heating capacity can be enhanced by using heat of the lighting system for preheating of the feed air.

With the heating and cooling apparatus according to the present invention, it is possible to easily do maintenance on the heat exchanger, the fan and the like from the opening part without detaching the entire apparatus from the ceiling, and workability becomes good. Further, it is possible to use the opening part as an inspection port, and it is unnecessary to provide the inspection port in the ceiling separately, whereby a cost reduction can be achieved.

With the heating and cooling apparatus according to the present invention, it is possible to use the opening part of the casing as the attaching space and the inspection port of the lighting system, and it is unnecessary to provide the inspection port in the ceiling separately, whereby a cost reduction can be achieved.

With the heating and cooling apparatus according to the present invention, any vain energy is not used for air conditioning and lighting when no person exists in the space to be air conditioned (the room inside), and an energy saving is achieved.

With the heating and cooling apparatus according to the present invention, since the heat transfer pipe of the heat exchanger is the elliptical pipe, the pressure loss is less, and it is possible to keep the effective length of the heat transfer pipe long without increasing the air blowing power, whereby in the case that the air conditioning heat exchanger is constructed by the cold/hot water coil, it is possible to significantly reduce the power of the pump due to the great temperature difference and the less water amount.

With the heating and cooling apparatus according to the present invention, since the back side of the ceiling is used as the so-called ceiling chamber, a duct is unnecessary and a cost reduction can be achieved. Since the heat in the back side of the ceiling is treat simultaneously, it is possible to prevent the heat emission from the ceiling face at a time of cooling, thereby achieving an energy saving.

With the heating and cooling apparatus according to the present invention, since the circulated air which is made to enter the mixer case through the guide path due to decreasing air pressure at the periphery of the guide path, and the feed air are mixed in the mixer case and supplied to the room inside while the feed air flows into the mixer case, and therefore it is possible to control the dew point to forgo a drain treatment equipment for measures against dew condensation so as to reduce the cost. Moreover, it is possible to reduce the cost by reduction of blast power and downsizing of equipments such as a duct by increasing the cooling capacity or the heating capacity per unit air volume of feed air (lowering or raising the air supply temperature than usual) so as to decrease the air supply volume.

With the heating and cooling apparatus according to the present invention, since circulated air is further suctioned from the room inside when circulated air in the circulated air path is suctioned via the guide path into the mixer case and the air pressure in the circulated air path lowers, such a structure functions as a so-called circulator and therefore it is unnecessary to provide a device for feeding the circulated air to the mixer case separately and it is possible to reduce the operating cost.

It is to be noted that the present invention carries out heat emission to the room inside from the heat storage radiation member via the opening as well as heat emission from the mixer case while a conventional radiation panel carries out only heat emission from the panel face, and therefore radiation (emission) energy can reach a long-distance point at a high rate. The temperature distribution of air at the room inside is uniformed due to synergetic effect of; the above long-distance radiation action; a heat transfer action to a long-distance point and to a wide area caused by decreasing the temperature difference between the room inside and the mixed air so as to prevent the mixed air from remaining close to the ceiling and emitting the mixed air in a laminar manner; and a circulator action to be caused by suctioning (induction) the circulated air, and comfortable air conditioning with high efficiency and high power can be achieved without the draft and temperature unevenness. Accordingly, space unsuitable for air conditioning is less than air conditioning employing only heat emission, and the present invention can be used more extensively.

With the heating and cooling apparatus according to the present invention, it is possible to suppress the draft to be given to the user of the room inside and to further uniform the temperature distribution at the room inside by dividing the flow of the mixed air and supplying the mixed air to the room inside in a laminar manner. Moreover, it is possible to transfer heat of mixed air efficiently and reliably to the entire area of the heat storage radiation member by the flow dividing fins and storage the heat, to conduct heat uniformly to the mixer case, and to always carry out stable heat emission.

With the heating and cooling apparatus according to the present invention, the heat storage pipe radiates heat obtained from the mixed air to the room inside and functions as a strengthening member. Moreover, the heat storage pipe can prevent occurrence of deformation such as warping of the flow dividing fins or the heat storage radiation member, and the mixed air can smoothly pass the heat storage radiation member with a low pressure loss in feed of the mixed air, which has passed the heat storage radiation member, to the room inside.

With the heating and cooling apparatus according to the present invention wherein a plurality of short tubular protrusions formed to protrude from a face of the flow dividing fins change the direction of radiation heating toward the room inside and the flow of mixed air to be supplied to the room inside is further divided, at this time, heat from the mixed air is obtained and transferred by contact between the protrusions and the mixed air further uniformly over the entire area of the heat storage radiation member and temperature unevenness at the room inside can be suppressed.

With the heating and cooling apparatus according to the present invention, a row of the protrusions of the flow dividing fins are positioned above the aperture of the mixer case so as to obstruct the aperture, flow division of mixed air in the longitudinal direction of the flow dividing fins is prompted, bypass (go by) to the aperture can be prevented reliably, and heat of mixed air can be transferred uniformly throughout the entire area of the heat storage radiation member. Moreover, since heat is also emitted obliquely downward from the flow dividing fins through the aperture of the mixer case to the room inside by the protrusions, the radiation (emission) energy can reach a wide area, the temperature distribution of air at the room inside is further uniformed, and comfortable air conditioning without temperature unevenness is achieved.

With the heating and cooling apparatus according to the present invention wherein mixed air is delivered along a central part of the mixer case and blown to the room inside through the heat storage radiation member, the flow of mixed air is divided reliably and the mixed air is made to flow in a laminar manner throughout the entire area of the heat storage radiation member without uneven distribution or bypass, heat can be conducted uniformly throughout the entire area of the mixer case, an effective air conditioning area per an element is wide, and the air conditioning efficiency can be enhanced. Moreover, the box member, which has a flat shape, can be installed easily even in a narrow ceiling, for example. Furthermore, only one air blowoff port is required for the adjustment case, and therefore the structure can be simplified and manufacturing can be facilitated.

With the heating and cooling apparatus according to the present invention, unevenness in the air volume and the wind velocity of adjusted air to be blown out from the air blowoff port can be suppressed over the entire face of the air blowoff port, the volume of circulated air to be suctioned via the guide path into the mixer case due to decreasing air pressure at the periphery of the guide path while the adjusted air flows from the adjustment case into the mixer case also becomes constant, and stable heating and cooling effect can be produced.

With the heating and cooling apparatus according to the present invention wherein a pair of an air blowoff port door member and a pair of an air suction port door member for adjusting the volume of the adjusted air to pass the air blowoff port or the air suction port are respectively attached to edge parts of both long sides of the rectangular air blowoff port or the rectangular air suction port, the volume of the adjusted air to pass the air blowoff port or the air suction port can be adjusted, the ratio of the adjusted air and circulated air in mixing of the mixed air can be adjusted, and the air volume and the wind velocity of mixed air to be fed to the room inside can be changed as occasion arises.

With the heating and cooling apparatus according to the present invention wherein circulated air in the circulated air path is suctioned into the mixer case through the space between the air blowoff port door member and the air suction port door member while the adjusted air flows from the adjustment case into the mixer case, it is unnecessary to provide a device for feeding the circulated air to the mixer case separately, and it is possible to reduce the operating cost.

With the heating and cooling apparatus according to the present invention wherein the adjustment case comprises a guiding piece for guiding the feed air to the air blowoff port, unevenness in the air volume and the wind velocity of adjusted air to be blown out from the air blowoff port can be suppressed over the entire face of the rectangular air blowoff port.

With the heating and cooling apparatus according to the present invention, it is possible to prevent occurrence of unevenness in the wind pressure and the wind velocity depending on the distance from the inlet in the adjustment case and to suppress ununiformity in the wind pressure and the wind velocity of adjusted air to be blown from the air blowoff port. Specifically, the inner space of the adjustment case is downsized from the windward side to the leeward side in the longitudinal direction of the air blowoff port, the wind pressure and the wind velocity can be uniformed over the entire area in the longitudinal direction of the air blowoff port and ununiformity does not arise. Accordingly, unevenness does not arise in suction of circulated air, the circulation effect is enhanced, circulated air and adjusted air can be mixed evenly, temperature unevenness does not arise in air to be emitted from the mixer case, and stable air conditioning can be achieved.

With the heating and cooling apparatus according to the present invention, since the air blowoff path doubles as the humidification space for humidifying the feed air, it is possible to prevent the apparatus from being increased in size and cost.

With the heating and cooling apparatus according to the present invention, since it is possible to sufficiently secure the vaporization and absorption distance in the humidification of the feed air, by the air blowing path, it is possible to enhance a saturation effect even in the compact air conditioning apparatus such as the fan coil and to enhance comfort by extending the temperature control range.

DETAILED DESCRIPTION

A description will be specifically given below of a case that a heating and cooling unit according to the present invention is a so-called pneumatic radiation laminar flow unit of the heating and cooling apparatus as an example, with reference to the drawings.

The heating and cooling unit (the pneumatic radiation laminar flow unit) is buried in a ceiling at the room inside, for example, and adjusts temperature and humidity of adjusted air (feed air) supplied from an air conditioning apparatus (not illustrated) so as to supply the air to the room inside.

(Embodiment 1)

Figure 1:
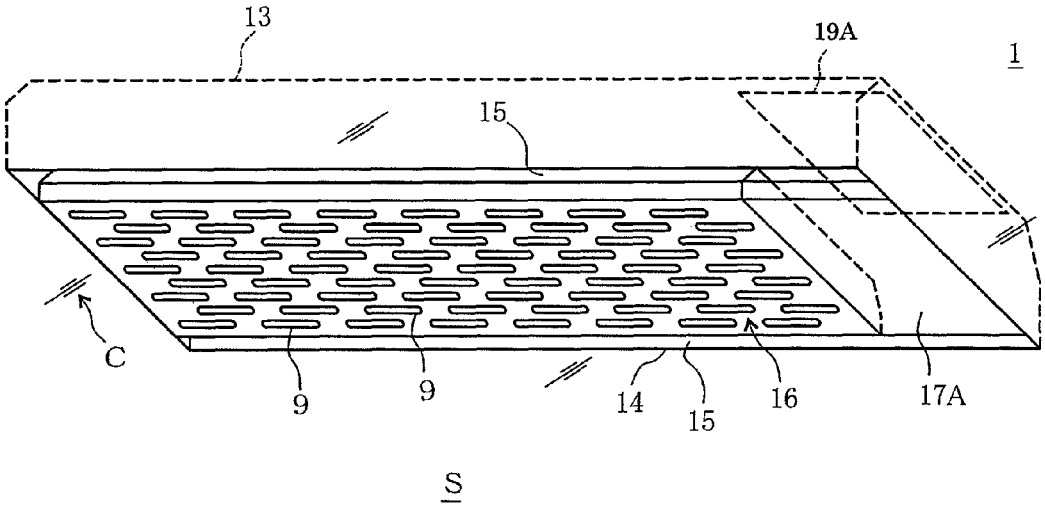
FIG. 1 is a perspective view of a heating and cooling unit of the present invention viewed from the bottom face side thereof.
Figure 2:
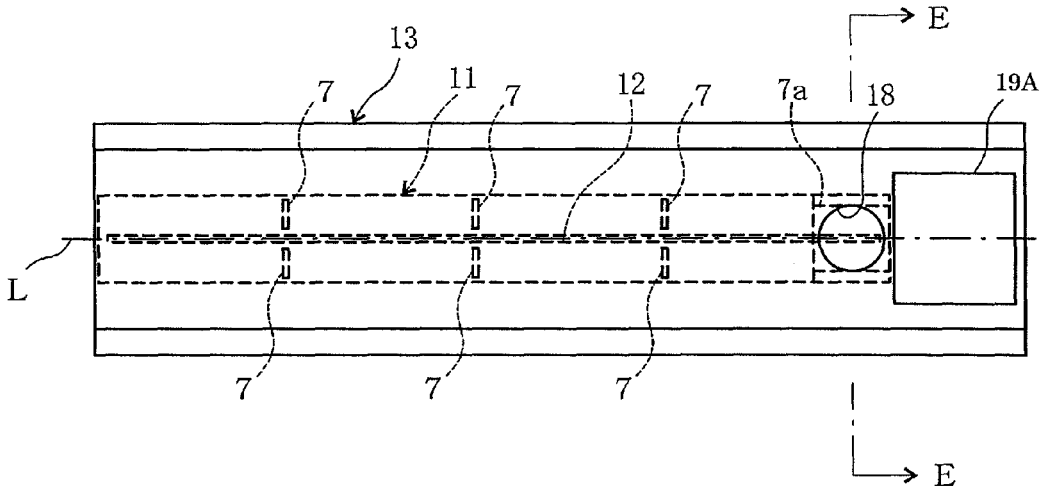
FIG. 2 is a plan view of a heating and cooling unit of the present invention.

FIG. 1 is a perspective view of a heating and cooling unit 1 of the present invention viewed from the bottom face side thereof, and FIG. 2 is a plan view of the heating and cooling unit 1 of the present invention. The heating and cooling unit 1 of the present invention comprises: a hood (box member) 13; an adjustment case 11 for receiving air-conditioned air from the air conditioning apparatus and adjusting the flow of the air-conditioned air; and a mixer case 16 for mixing air-conditioned air delivered from the adjustment case 11 with circulated air from the room inside and delivering the air to the room inside.

Figure 3:
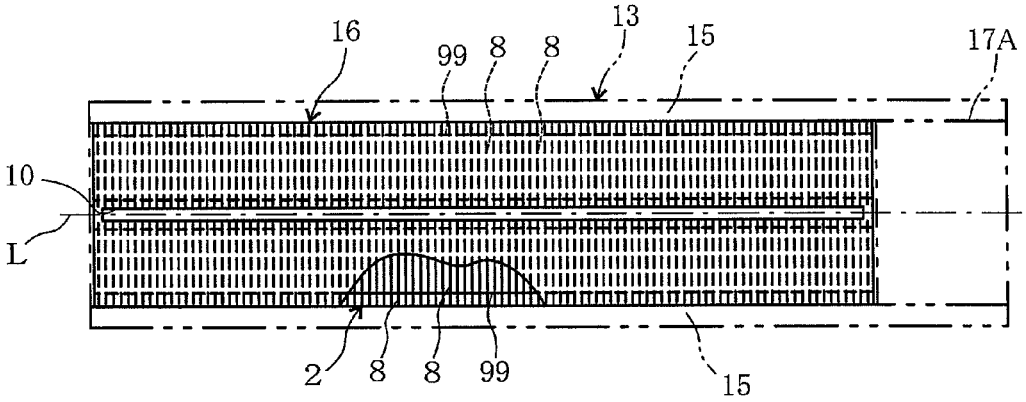
FIG. 3 is a plan view of a heating and cooling unit of the present invention wherein a part of an upper face of a mixer case thereof is cut away.
Figure 4:
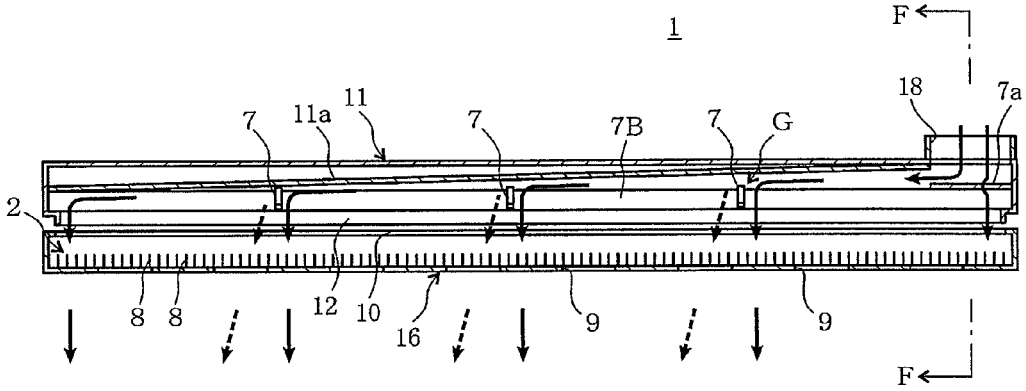
FIG. 4 is a sectional side view of an adjustment case and a mixer case of a heating and cooling unit of the present invention
Figure 5:
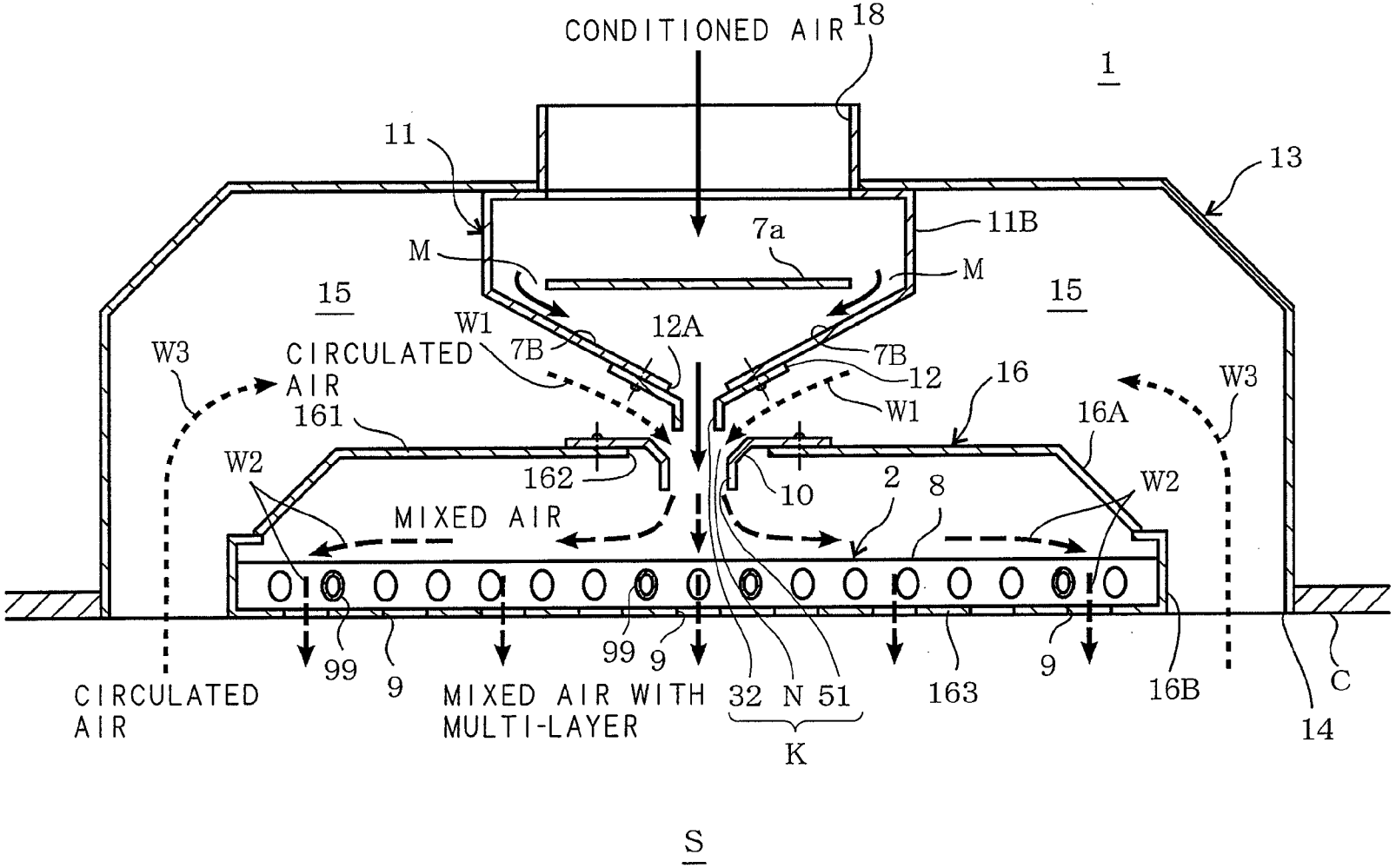
FIG. 5 is an overall sectional view viewed from the E direction of FIG. 2.
Figure 7:
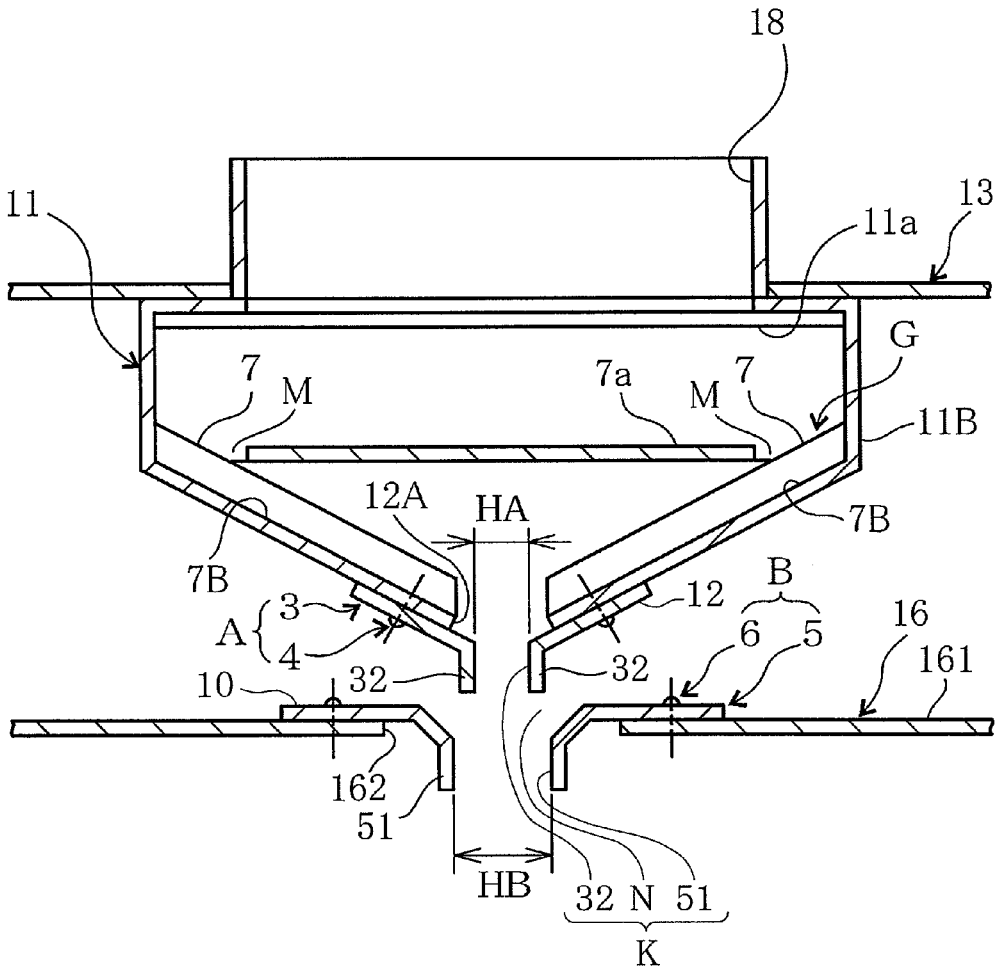
FIG. 7 is a sectional view of a main part of an adjustment case and a mixer case viewed from the F direction of FIG. 4.

FIG. 3 is a plan view of the heating and cooling unit 1 of the present invention wherein a part of an upper face of the mixer case 16 thereof is cut away, FIG. 4 is a sectional side view of the adjustment case 11 and the mixer case 16 of the heating and cooling unit 1 of the present invention, FIG. 5 is an overall sectional view viewed from the E direction of FIG. 2, and FIG. 7 is a sectional view of a main part of the adjustment case 11 and the mixer case 16 viewed from the F direction of FIG. 4.

The hood 13 of the heating and cooling unit 1 of the present invention is buried in a ceiling C at room inside S, and the adjustment case 11 and the mixer case 16 are held inside the hood 13.

The hood 13 is a flat rectangular parallelepiped box member having a lower opening part 14 at one face thereof. The hood 13 is buried in the ceiling C in a manner such that the one face having the lower opening part 14 faces the room inside S so as to form a flat face with the ceiling C, and a rectangular inspection port 19A is provided at one end part of the other face opposed to the one face. The inspection port 19A penetrates the hood 13 from the inside thereof to the outside thereof, and a cover is provided so as to be openable and closable. Moreover, a rectangular inspection panel 17A is attached to the one face of the hood 13 at a position opposed to the inspection port 19A so as to be detachable. The inspection panel 17A is attached at a position close to one end side of the hood 13 in the vicinity of the inspection port 19A so as to form a flat face with the ceiling C. The hood 13 of the heating and cooling unit 1 of the present invention having such a structure can be easily installed even in a narrow ceiling.

Moreover, the adjustment case 11 is attached to the other face of the hood 13, the mixer case 16 is located below the adjustment case 11 so as to be opposed to the adjustment case 11, and the adjustment case 11 and the mixer case 16 are surrounded by a side wall of the hood 13. It is to be noted that a circulated air path 15 for delivering circulated air at the room inside S from the lower opening part 14 to a guide path K, which will be described later, is formed between the adjustment case 11 and mixer case 16 and the inside of the hood 13. That is, the circulated air path 15 is communicatively connected with the room inside (circulated air) so that circulated air can always enter or exit the circulated air path 15, and circulated air is suctioned into the guide path K via the circulated air path 15.

The adjustment case 11 comprises: an air inlet 18 for receiving air-conditioned air from the air conditioning apparatus; a holder case part 11B for holding air-conditioned air from the air inlet 18 and adjusting the flow, such as the wind direction, the wind velocity or the air volume, of air-conditioned air; and an air blowoff port 12A for blowing adjusted air, the flow of which is adjusted at the holder case part 11B, outward from the adjustment case 11. The air blowoff port 12A has a rectangular shape and is formed at the lower side of the holder case part 11B, and the adjustment case 11 is constructed to narrow toward the air blowoff port 12A.

The air inlet 18 has a cylindrical shape and is provided to penetrate the other face of the hood 13 from the inside thereof to the outside thereof in the vicinity of the inspection port 19A of the hood 13.

With the above structure, maintenance on the heating and cooling unit 1 can be carried out easily from the inspection panel 17A without detaching the entire heating and cooling unit 1 from the ceiling C or providing an inspection port at the ceiling C separately. Moreover, since the air inlet 18 of the adjustment case 11 is positioned adjacent to the inspection port 19A, construction, maintenance and the like of a fan duct (omitted in the drawings) of air-conditioned air can be carried out using the inspection panel 17A and the inspection port 19A, and satisfactory workability is realized. It is to be noted that the present invention is not limited to this and may be constructed without providing the inspection panel 17A and the inspection port 19A.

The holder case part 11B is connected with an edge at the lower side of the air inlet 18, has a taper shape narrowing downward, and is a box member extended along the longitudinal direction of the hood 13. A plurality of small wall strip parts 7, 7, . . . 7 for guiding air-conditioned air from the air inlet 18 to the air blowoff port 12A and an inclined plate (suppression structure) 11*a* for suppressing unevenness of the air volume and the wind velocity of adjusted air to be blown from the air blowoff port 12A are provided inside the holder case part 11B.

Figure 8:
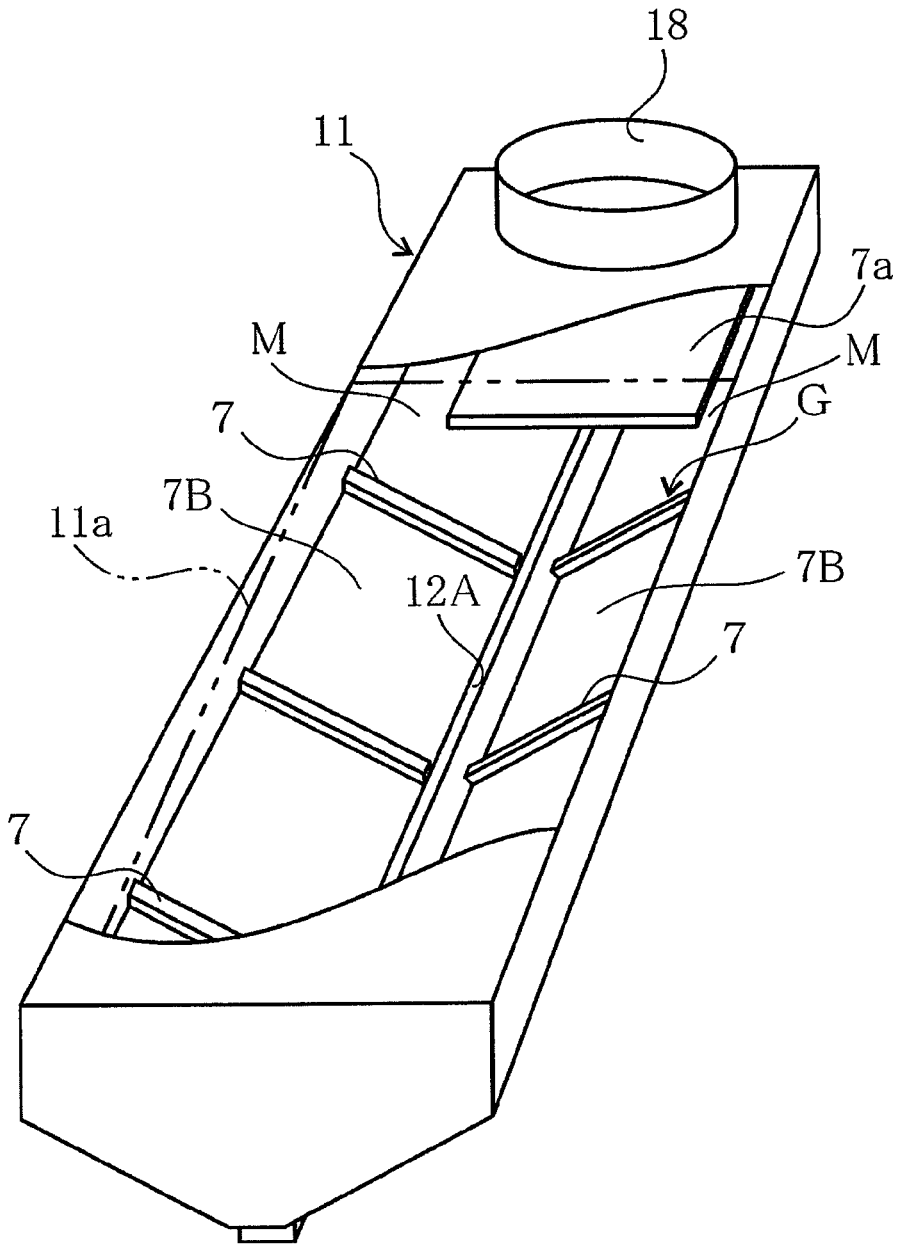
FIG. 8 is a perspective view of a heating and cooling unit of the present invention wherein a part of an upper face of an adjustment case thereof is cut away.

FIG. 8 is a perspective view of the heating and cooling unit 1 of the present invention wherein a part of an upper face of the adjustment case 11 thereof is cut away. The holder case part 11B comprises two opposed inclined walls 7B, 7B, which are inclined in a symmetric fashion, and the small wall strip parts 7, 7, . . . 7 are provided to protrude from the inside of the respective inclined walls 7B, 7B. The small wall strip parts 7, 7, . . . 7 have a rectangular shape and are juxtaposed at an interval at the inclined walls 7B, 7B in a manner such that the longitudinal direction thereof is oriented to the vertical direction. When air-conditioned air from the air inlet 18 collides with the small wall strip parts 7, 7, . . . 7, the wind direction thereof is changed and the air-conditioned air can be guided toward the air blowoff port 12A.

The dimension (height) of the small wall strip parts 7, 7, . . . 7 in the protrusion direction and the dimension (width) thereof in a direction crossing the protrusion direction can be freely changed, though it is preferable to set a vertical cross section of the small wall strip parts 7, 7, . . . 7 to be 10-30% of the maximum cross section in the direction of the shorter side of the adjustment case 11. This is because the wind direction cannot be adjusted when the height of the small wall strip parts 7, 7, . . . 7 is too low, while air-conditioned air from the air inlet 18 cannot reach the leeward part of the small wall strip parts 7, 7, . . . 7 as indicated by the bold dot-line arrows of FIG. 4 and a part where air does not flow is generated intermittently in a space between the bold dot-line arrows and the bold full-line arrows when the height is too high. It is to be noted that the full-line arrows in FIG. 4 indicate the wind direction to be generated by the small wall strip parts 7, 7, . . . 7 regardless of the height.

That is to say, in the heating and cooling unit 1 of Embodiment 1 of the present invention, a rectifier structure G composed of the inner face of the inclined walls 7B, 7B and the small wall strip parts 7, 7, . . . 7 is provided at the adjustment case 11. Air-conditioned air which enters the unit from the air inlet 18 is guided by the rectifier structure G, or more specifically, the wind direction thereof is changed to vertically downward by resistance of the inner face of the inclined walls 7B, 7B and the small wall strip parts 7, 7, . . . 7, so that the air-conditioned air flows toward the air blowoff port 12A.

The inclined plate 11*a* has a rectangular plate shape which is extended along the longitudinal direction of the holder case part 11B. The inclined plate 11*a* is located to be opposed to the air blowoff port 12A in a manner such that the distance from the air blowoff port 12A gradually changes along the longitudinal direction. More specifically, the inclined plate 11*a* is attached to be inclined downward, that is, in a manner such that the distance from the air blowoff port 12A is the largest in the vicinity of the air inlet 18 and gradually decreases with increase in the distance from the air inlet 18. Accordingly, it is possible to prevent occurrence of ununiformity in the air pressure between an area near to the air inlet 18 and an area far from the air inlet 18 in the holder case part 11B and to suppress unevenness of the air volume and the wind velocity of adjusted air to be blown from the air blowoff port 12A.

A partition plate 7*a* for guiding air-conditioned air from the air inlet 18 in the longitudinal direction of the adjustment case 11 is provided directly below the air inlet 18. The partition plate 7*a* is located to be opposed to the air inlet 18, and a clearance M is provided between the partition plate 7*a* and the inclined walls 7B, 7B. Accordingly, most of air-conditioned air from the air conditioning apparatus enters the unit from the air inlet 18 collides with the partition plate 7*a*, the wind direction thereof is changed to the longitudinal direction of the adjustment case 11, and only a part flows through the clearance M toward the air blowoff port 12A.

It is to be noted that the present invention is not limited to the example explained in Embodiment 1 of the present invention wherein the adjustment case 11 has a funnel-shaped cross section (or taper shape) narrowing toward the air blowoff port 12A having a wide upper part and a thinned lower part as described above.

The mixer case 16 has a flat box shape, is attached in the hood 13 so as to be detachable and comprises: a mounting part 16B where a heat storage radiation flow divider (heat storage radiation member) 2, which will be described later, is attached; and a cover part 16A for covering the mounting part 16B. The cover part 16A and the mounting part 16B are formed in an integrated manner.

The mounting part 16B is a flat rectangular parallelepiped box member having an opening at one face thereof at the upper side. The heat storage radiation flow divider 2 for obtaining low heat or high heat from mixed air and radiating heat toward the room inside is attached to the inner side of the other face (aperture face) 163 at the lower side opposed to the one face of the mounting part 16B so as to be thermally conducted with the mounting part 16B. Accordingly, heat stored in the heat storage radiation flow divider 2 is transferred to the mounting part 16B and the cover part 16A, and radiation heat (low heat or high heat) can reach a long-distance point with high efficiency by carrying out radiation cooling or radiation heating to the room inside S not only by the heat storage radiation flow divider 2 but also by the mounting part 16B and the cover part 16A.

Moreover, a plurality of apertures 9, 9, . . . 9 for blowing the mixed air to the outside (room inside 5) are provided at the other face 163 of the mounting part 16B. The apertures 9, 9, . . . 9 are long holes which penetrate the mixer case 16 (mounting part 16B) from the inside thereof to the outside thereof. Mixed air in the mixer case 16 passes the heat storage radiation flow divider 2 and the apertures 9, 9, . . . 9, and is supplied to the room inside. The present invention is not limited to the example explained in Embodiment 1 of the present invention wherein the apertures 9, 9, . . . 9 are long holes, and the apertures 9, 9, . . . 9 may have a shape such as a round shape or a rectangular shape. Moreover, the arrangement, the number or the like of the apertures 9, 9, . . . 9 may be changed as occasion rises.

It is to be noted that it is preferable to set the total area ratio of the whole area of the apertures 9, 9, . . . 9 to the whole area of the other face 163 of the mixer case 16 (mounting part 16B) equal to or larger than 30% in order to maximize the radiation heating action of the heat storage radiation flow divider 2 and the mixer case 16 to the room inside S and the heat transfer action by mixed air emission from the mixer case 16, though the present invention is not limited to this.

The heat storage radiation flow divider 2 comprises: a plurality of heat transfer plate (flow dividing fin)s 8, 8, . . . 8; and a plurality of elliptical heat storage pipes 99, 99, . . . 99 for storing low heat or high heat transferred from the heat transfer plates 8, 8, . . . 8. The heat transfer plates 8, 8, . . . 8 have a rectangular shape, obtain low heat or high heat from the mixed air, and transfer heat to the mounting part 16B, the cover part 16A and the elliptical heat storage pipes 99, 99, . . . 99. The elliptical heat storage pipes 99, 99, . . . 99 have an elliptical longitudinal section, and are attached in a manner such that the major axis direction of the ellipse is oriented to the vertical direction. Accordingly, mixed air in the mixer case 16 can pass the heat storage radiation flow divider 2 smoothly with a low pressure loss.

The heat transfer plates 8, 8, . . . 8 are made of, for example, aluminum, copper, mica, titanium, Carbolite or the like having high thermal conductivity and high thermal emissivity, and are juxtaposed to be opposed to each other at a proper interval in the direction of the shorter side of the mounting part 16B. The elliptical heat storage pipes 99, 99, . . . 99 are installed so as to penetrate the heat transfer plates 8, 8, . . . 8 in the juxtaposition direction of the heat transfer plates 8, 8, . . . 8. It is to be noted that the elliptical heat storage pipes 99, 99, . . . 99 are made of copper, mica, titanium, Carbolite or the like and are juxtaposed along the longitudinal direction of the heat transfer plates 8, and the heat storage radiation flow divider 2 has a flat rectangular parallelepiped shape as a whole, similar to the inner shape of the mounting part 16B.

With such a structure, the wind velocity of mixed air in the mixer case 16 to pass the heat storage radiation flow divider 2 is decreased by the heat transfer plates 8, 8, . . . 8, the flow of the mixed air is divided into a plurality of layers and the mixed air is supplied to the room inside S in a so-called multi-layer flow manner, and therefore it is possible to suppress the draft to be given to the user of the room inside S.

It is to be noted that the present invention is not limited to the example explained in the present embodiment wherein a plurality of elliptical heat storage pipes 99, 99, . . . 99 are provided, and one long elliptical heat storage pipe 99 may be folded to have a meandering shape. Moreover, the elliptical heat storage pipes 99, 99, . . . 99 may have not an elliptical cross section but a circular cross section.

Figure 6:
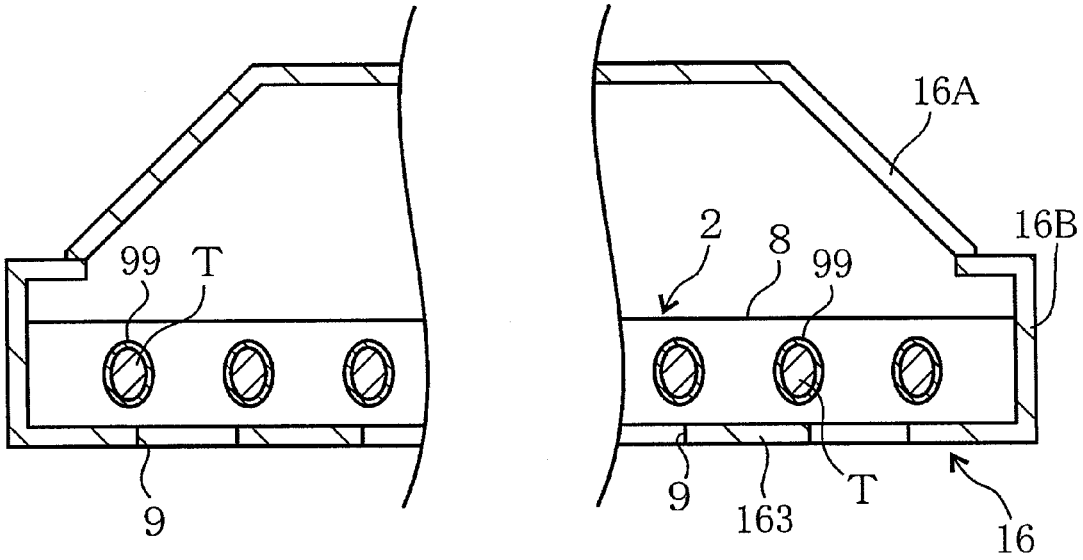
FIG. 6 is a sectional view for illustrating a main part of a variation of a heat storage radiation flow divider of Embodiment 1 of the present invention.

Moreover, the structure of the elliptical heat storage pipes 99, 99, . . . 99 is not limited to the above description. FIG. 6 is a sectional view for illustrating a main part of a variation of a heat storage radiation flow divider 2 of Embodiment 1 of the present invention. A heat storage member T for obtaining heat of the mixed air via the elliptical heat storage pipes 99, 99, . . . 99 and storing the heat is filled in the elliptical heat storage pipes 99, 99, . . . 99. The heat storage member T needs only to be made of material which can store heat and release heat for a long period of time, and may be in a liquid state or a solid state.

Moreover, the shape, the number, the pitch and the like of the heat transfer plates 8, 8, . . . 8 and the apertures 9, 9, . . . 9 are set in a manner such that the velocity of mixed air before passing the heat storage radiation flow divider 2 is decreased to be equal to or lower than half of the velocity of mixed air after passing the heat storage radiation flow divider 2, or more preferably equal to or lower than 20% to 30%, in order to ensure an optimum function of flow division, diffusion, heat transfer action and the like of mixed air to the room inside S.

On the other hand, the cover part 16A is provided to cover the one face of the mounting part 16B at the upper side. The cover part 16A has a shape to be obtained by folding an outer edge of an upper plate 161, which is made of a rectangular plate material having a size substantially equal to the heat storage radiation flow divider 2, downward and extending the same. Accordingly, a space surrounded by the inner face of the cover part 16A and the heat storage radiation flow divider 2 is formed in the mixer case 16. In the space, adjusted air from the adjustment case 11 and circulated air from the circulated air path 15 are mixed by a method, which will be described later, and become mixed air.

Moreover, in the cover part 16A, an induction port (air suction port) 162 for suctioning adjusted air from the adjustment case 11 and inducing and suctioning circulated air from the circulated air path 15 is provided at a central part (denoted by L in FIG. 3) in the direction of the shorter side of the upper plate 161. The induction port 162 has a rectangular shape elongated in the longitudinal direction of the upper plate 161 and is formed to be opposed to the air blowoff port 12A of the adjustment case 11. It is to be noted that the induction port 162 is formed at the midpoint between two opposed side faces of the upper plate 161 in the lateral direction and constructed to be matched with the air blowoff port 12A. It is to be noted that the circulated air path 15 is formed outside the two side faces and the upper plate 161.

Further, the heating and cooling unit 1 according to the present invention is provided with the guide path K guiding the adjusted air blown out from the air blowoff port 12A of the adjustment case 11 to the mixer case 16. The guide path K includes a part of the air blowoff guide 12 (or the air blowoff port air volume adjustment member 3), and a part of the induction guide 10 (or the induction port air volume adjustment member 5). More particularly, the guide path K is constructed by the guide flange 32 of the air blowoff guide 12 (or the air blowoff port air volume adjustment member 3), the space N, and the guide flange 51 of the induction guide 10 (or the induction port air volume adjustment member 5), and the adjusted air blown out from the air blowoff port 12A is guided by the guide path K, and flows into the induction port 162. At this time, the circulated air from the room inside S is suctioned into the induction port 162 through the guide path K from the space N via the circulated air path 15.

The air blowoff guide 12 is attached to a lower end part of the inclined walls 7B, 7B of the adjustment case 11 in the vicinity of the air blowoff port 12A, and guides the wind direction of adjusted air blown from the air blowoff port 12A to flow into the induction port 162. Moreover, the air blowoff guide 12 comprises an air volume adjustment structure A for adjusting the air volume of the adjusted air. The air volume adjustment structure A is composed of: a pair of air blowoff port air volume adjustment members 3, 3 attached to the outer side of a lower end part of the inclined walls 7B, 7B so as to be slidable; and screw members 4, 4 for fixing the air blowoff port air volume adjustment members 3, 3 so as to be slidable.

The air blowoff port air volume adjustment members 3, 3 are made of rectangular plate materials having a longitudinal dimension substantially equal to the longitudinal dimension of the air blowoff port 12A. An upper end part of each of the air blowoff port air volume adjustment members 3, 3 in the lateral direction is fixed at an edge part at each long side of the air blowoff port 12A by each of the screw members 4, 4 so as to be slidable, and a lower end part of each of the air blowoff port air volume adjustment members 3, 3 is folded and extended toward the induction port 162 to form each of guide flanges 32, 32.

For example, a long through hole is provided at an upper end part of each of the air blowoff port air volume adjustment members 3, 3, and each air blowoff port air volume adjustment member 3 is fixed by a screw member 4, such as a screw or a rivet, having a diameter equal to the minor axis of the long through hole so as to be slidable in the major axis direction of the long through hole. The air volume of adjusted air to be blown from the air blowoff port 12A can be adjusted when the pair of air blowoff port air volume adjustment members 3, 3 slide respectively along the outer face of the inclined walls 7B, 7B in the incline direction thereof so as to open or close the air blowoff port 12A, that is, when the interval (HA) between the air blowoff port air volume adjustment members 3, 3 increases or decreases. It is to be noted that adjusted air to be blown from the air blowoff port 12A exits the air blowoff port 12A and then the wind direction thereof is guided by the guide flanges 32, 32. That is to say, the air blowoff guide 12 functions to adjust the air volume of the adjusted air and to guide the adjusted air.

The induction guide 10 is attached to a central part of the upper plate 161 in the vicinity of the induction port 162 and guides adjusted air to be blown from the air blowoff port 12A so as to be suctioned into the induction port 162 and guides circulated air from the circulated air path 15 so as to be induced and suctioned. The induction guide 10 is located to be opposed to the air blowoff guide 12 across the space N as described above.

Moreover, the induction guide 10 comprises an air volume adjustment structure B for adjusting the volume of air to be suctioned. The air volume adjustment structure B is composed of: a pair of induction port air volume adjustment members 5, 5 attached to the outer side of the upper plate 161 so as to be slidable; and screw members 6, 6 for fixing the induction port air volume adjustment members 5, 5 so as to be slidable.

The induction port air volume adjustment members 5, 5 are made of rectangular plate materials having a longitudinal dimension substantially equal to the longitudinal dimension of the induction port 162. An outer end part of the central part at the outer side in the direction of the shorter side of each of the induction port air volume adjustment members 5, 5 is fixed at an edge part at each long side of the induction port 162 by each of the screw members 6, 6 so as to be slidable. Moreover, an inner end part of each of the induction port air volume adjustment members 5, 5 is folded and extended toward the inner side of the mixer case 16 so as to form each of the guide flanges 51, 51.

For example, a long through hole is provided at an outer end part of each of the induction port air volume adjustment members 5, 5, and each induction port air volume adjustment member 5 is fixed by a screw member 6, such as a screw or a rivet, having a diameter equal to the minor axis of the long through hole so as to be slidable in the major axis direction of the long through hole. The volume of air to be suctioned into the induction port 162 can be adjusted when the pair of induction port air volume adjustment members 5, 5 slide respectively along the outer face of the upper plate 161 so as to open or close the induction port 162, that is, when the interval (HB) between the induction port air volume adjustment members 5, 5 increases or decreases. It is to be noted that the wind direction of air, which passes the induction port 162, is guided by the guide flanges 51, 51.

The present invention is not limited to the example explained in Embodiment 1 of the present invention wherein the lower end part of the air blowoff port air volume adjustment members 3 and the inner end part of the induction port air volume adjustment members 5 are folded. It is to be noted that any one of the air blowoff guide 12 and the induction guide 10 may be omitted.

The following description will explain a method of inducing and suctioning circulated air in the circulated air path 15 into the mixer case 16 and mixing the circulated air with adjusted air from the adjustment case 11 so as to make mixed air.

When adjusted air blown from the air blowoff port 12A (air blowoff guide 12) is suctioned into the induction port 162 (induction guide 10), the air pressure around the air flow from the air blowoff port 12A to the induction port 162 lowers. On the other hand, the air blowoff guide 12 (air blowoff port 12A) and the induction guide 10 (induction port 162) in Embodiment 1 are located in opposed positions across the space N, through which air in the vicinity (circulated air in the circulated air path 15) flows into the induction guide 10 (the induction port 162). Accordingly, when the air pressure around the air flow lowers, circulated air in the circulated air path 15 is caught up in the air flow (as indicated by the dot-line arrows W1 in FIG. 5). Circulated air induced in such a manner is suctioned into the mixer case 16 together with adjusted air and is mixed with the adjusted air, the flow of the air is divided, (as indicated by the dot-line arrows W2 in FIG. 5) and the air is supplied to the room inside S. At this time, it is preferable to set the ratio of adjusted air and circulated air to approximately 6:4, though the present invention is not limited to this.

It is to be noted that the air pressure in the circulated air path 15 lowers by the volume of circulated air suctioned into the mixer case 16 at this time, and circulated air is supplied from the room inside (as indicated by the dot-line arrows W3 in FIG. 5) since the circulated air path 15 is communicatively connected with the room inside (circulated air) as described above.

By repeating the above operation, air is convected, circulated and stirred between the room inside S and the heating and cooling unit 1. The room inside S is air-conditioned by mixed air having a temperature lower than the room inside S and low heat emission at the time of cooling, while the room inside S is air-conditioned by mixed air having a temperature higher than the room inside S and high heat emission at the time of heating. Air-conditioned air is set, for example, to have a temperature higher than the dew-point temperature of the room inside S and a low absolute humidity when mixed with circulated air in order to prevent dew condensation and enhance the air conditioning efficiency, though the present invention is not limited to this.

Moreover, the guide path K is not limited to such a structure. For example, the feed path K may be constructed without providing the air blowoff guide 12 and the induction guide 10. Moreover, the feed path K may be constructed by connecting the air blowoff port 12A with the induction port 162 by a guide path member such as bellows and providing a hole at the guide path member so as to be communicated with circulated air in the circulated air path 15.

(Embodiment 2)

Figure 9:
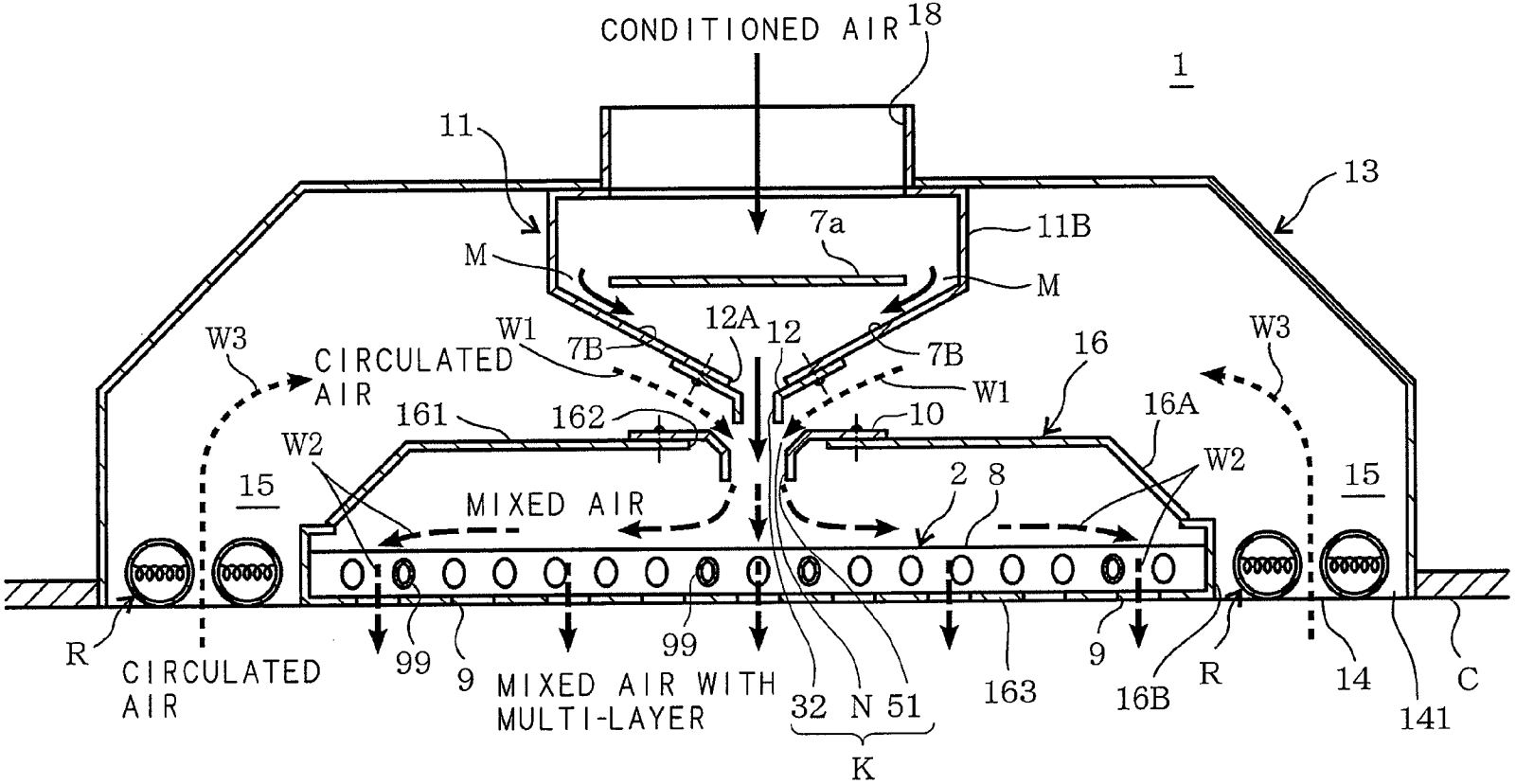
FIG. 9 is a sectional view of a main part of a heating and cooling unit of Embodiment 2 of the present invention.

FIG. 9 is a sectional view of a main part of a heating and cooling unit 1 of Embodiment 2 of the present invention. In the heating and cooling unit 1 of Embodiment 2, a lighting system R for lighting room inside S is provided at an edge part of a lower opening part 14 of a hood 13.

The size of the other face 163 of a mounting part 16B is smaller than the size of the lower opening part 14 of the hood 13, and a clearance (passage clearance) 141 is formed between the lower opening part 14 of the hood 13 and the other face 163 of the mounting part 16B when the heating and cooling unit 1 is installed. Circulated air from the room inside S passes the clearance 141 and is suctioned into a circulated air path 15.

The lighting system R is provided at the clearance 141 in a proper manner. The lighting system R is provided so as not to obstruct circulated air passing the clearance 141, so that circulated air can pass freely. That is to say, the lighting system R is exposed to circulated air passing the clearance 141. Accordingly, circulated air passing the clearance 141 comes into contact with the lighting system R and obtains heat generated by the lighting system R. The obtained heat is used for reheating or preheating in mixing of the air-conditioned air and circulated air. That is, at the time of cooling with a large cooling capacity per unit air volume of the air-conditioned air (when the air supply temperature is lowered than usual), heat from the lighting system R is used for reheating of air-conditioned air and therefore it is possible to prevent dew condensation reliably and to further decrease the air supply volume of air-conditioned air so as to further reduce the cost. Moreover, at the time of heating, heat from the lighting system R is used for preheating of air-conditioned air and therefore it is possible to decrease the capacity of a device for feeding the air-conditioned air and to enhance the heating capacity.

The lighting system R is, for example, a fluorescent tube, an incandescent lamp or an LED, and the number, the position thereof or the like can be changed in a proper manner.

Identical codes are used to refer to parts identical to those of Embodiment 1, and detailed explanation thereof will be omitted.

(Embodiment 3)

Figure 10:
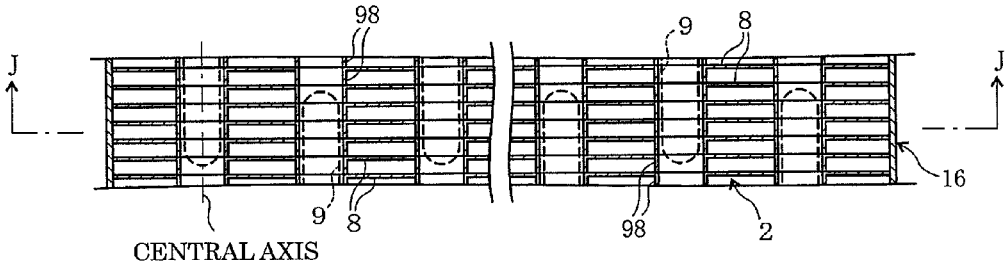
FIG. 10 is a sectional view of a main part of a heat storage radiation flow divider of Embodiment 3 of the present invention wherein a part thereof is omitted.
Figure 11:
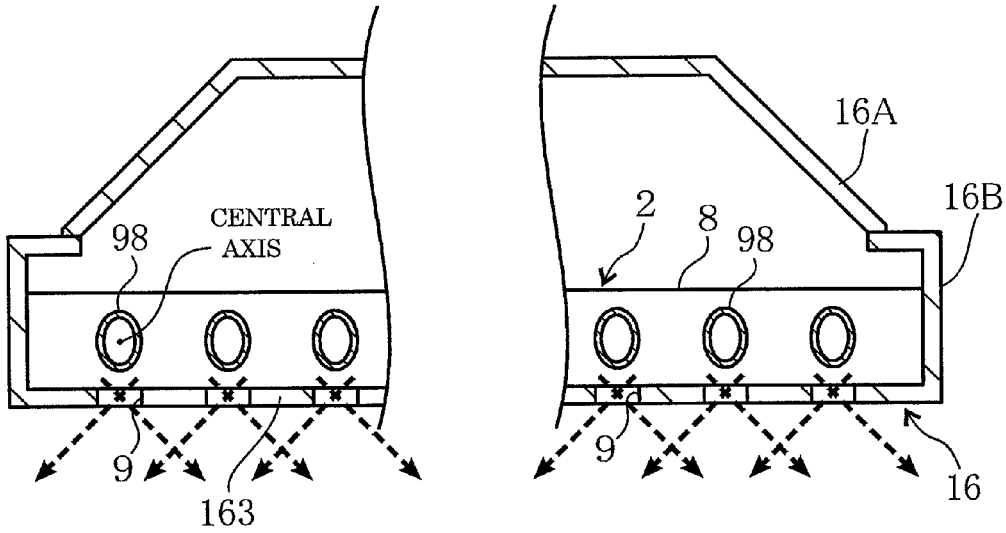
FIG. 11 is a sectional view of a main part of a mixer case and a heat storage radiation flow divider of Embodiment 3 viewed from the J direction of FIG. 10.

FIG. 10 is a sectional view of a main part of a heat storage radiation flow divider 2 of Embodiment 3 of the present invention wherein a part thereof is omitted, and FIG. 11 is a sectional view of a main part of a mixer case 16 and a heat storage radiation flow divider 2 of Embodiment 3 viewed from the J direction of FIG. 10.

A heating and cooling unit 1 of Embodiment 3 comprises short tubular protrusions 98, 98, 98, . . . 98 formed to protrude from one face of each heat transfer plate 8.

The protrusions 98, 98, 98, . . . 98 are juxtaposed at one face of each heat transfer plate 8 at a proper interval along the longitudinal direction of the heat transfer plate 8. More particularly, apertures 9 are juxtaposed below the respective protrusions 98 at a predetermined interval as illustrated in FIG. 10. The protrusions 98 have an elliptical cross section and are provided in a manner such that the major axis direction of the ellipse is oriented to the vertical direction. Moreover, the protrusions 98, 98, 98, . . . 98 are further juxtaposed in the juxtaposition direction of the heat transfer plates 8, 8, 8, . . . 8 with each central axis thereof being positioned on the same line.

The protrusions 98 have heat storage capability, and obtain heat from mixed air via the heat transfer plates 8, store the heat and radiate the heat toward the room inside S. A protrusion 98 of one heat transfer plate 8 is extended to come into contact with another adjacent heat transfer plate 8 and supports the adjacent heat transfer plate 8 so as to prevent warping of the adjacent heat transfer plate 8.

The following description will explain the action of the protrusions 98.

Radiation heating to the room inside S by the heat storage radiation flow divider 2 is directed downward via the apertures 9, 9, 9, . . . 9. In such a manner, since heat proceeds getting around the protrusions 98 as indicated by the dot-line arrows in FIG. 11, radiation heating is directed obliquely downward from the apertures 9 in the vicinity of a local area below the protrusions 98. That is, radiation heating in the vicinity of the protrusions 98 widely moves directly downward and obliquely downward from the apertures 9 since heat moves downward along the peripheral face of the protrusions 98. Accordingly, it is possible to uniform the temperature distribution at the room inside S.

Moreover, since the flow of mixed air to pass the apertures 9, 9, 9, . . . 9 is further divided not only by the heat transfer plates 8, 8, . . . 8 but also by the protrusions 98, 98, 98, . . . 98, the wind velocity of the mixed air is further lowered and the mixed air is supplied to the room inside S in a further fine multi-layer flow manner and therefore it is possible to suppress the draft to be given to the user of the room inside S.

The present invention is not limited to the example explained in Embodiment 3 wherein the protrusion 98 of one heat transfer plate 8 is extended to come into contact with another adjacent heat transfer plate 8, and a protrusion 98 of one heat transfer plate 8 may be extended in a proper manner to the vicinity of another adjacent heat transfer plate 8. Moreover, the protrusion 98 may be formed to be integrated with a heat transfer plate 8, or may be constructed so as to be detachable.

Moreover, the present invention is not limited to the example explained in Embodiment 3 wherein the protrusions 98 have an elliptical shape, and the protrusions 98 may have a circular shape or a polygonal shape.

Identical codes are used to refer to parts identical to those of Embodiment 1, and detailed explanation thereof will be omitted.

A description will be specifically given below of a case that the heating and cooling apparatus according to the present invention is a so-called induction emission air conditioning apparatus as an example, with reference to the drawings.

(Embodiment 4)

Figure 12:
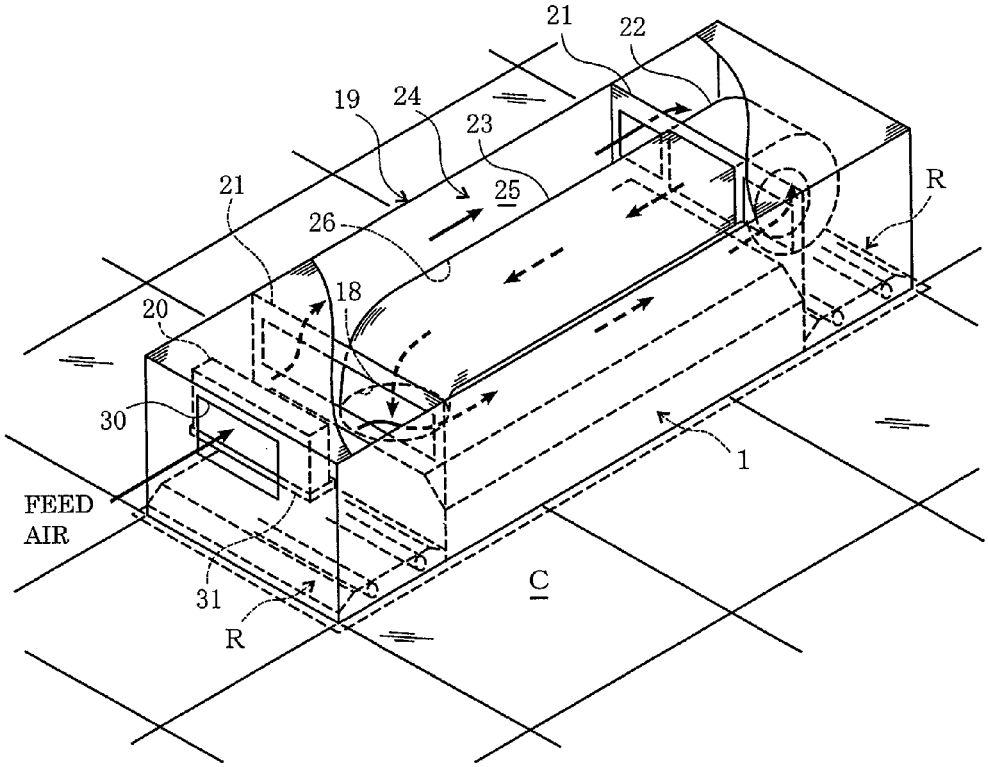
FIG. 12 is a perspective view illustrating the case of installing an induction emission air conditioning apparatus according to Embodiment 4 of the present invention in a ceiling wherein a part of an upper face thereof is cut away, and viewed from the above.
Figure 13:
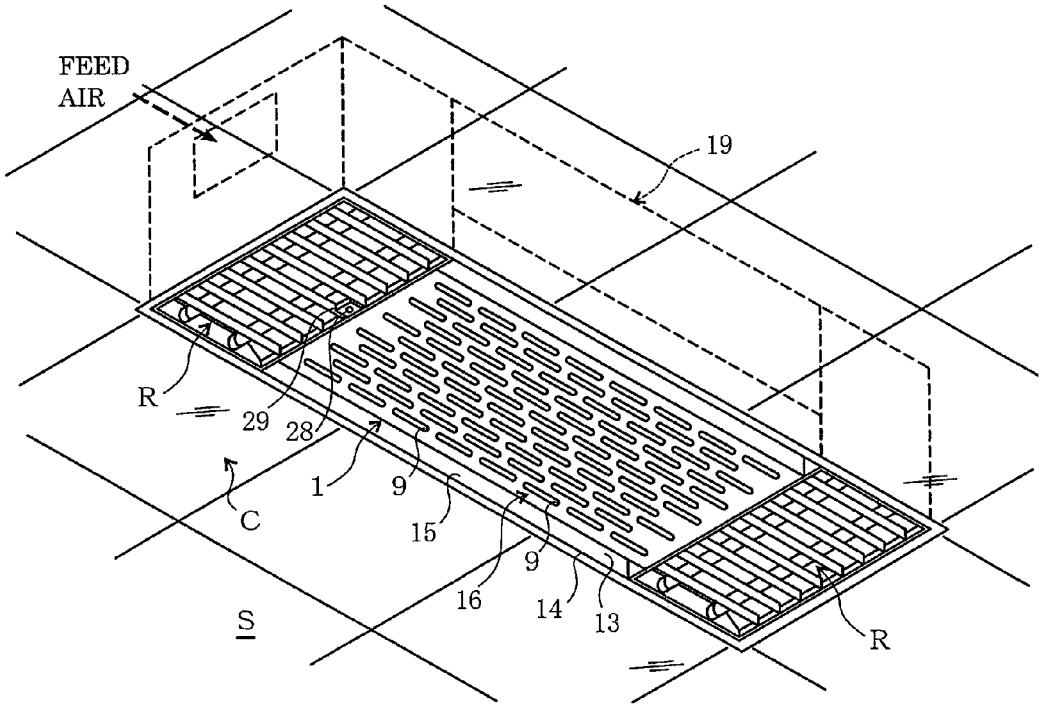
FIG. 13 is a perspective view of the induction emission air conditioning apparatus according to Embodiment 4 of the present invention viewed from a room inside side thereof.
Figure 14:
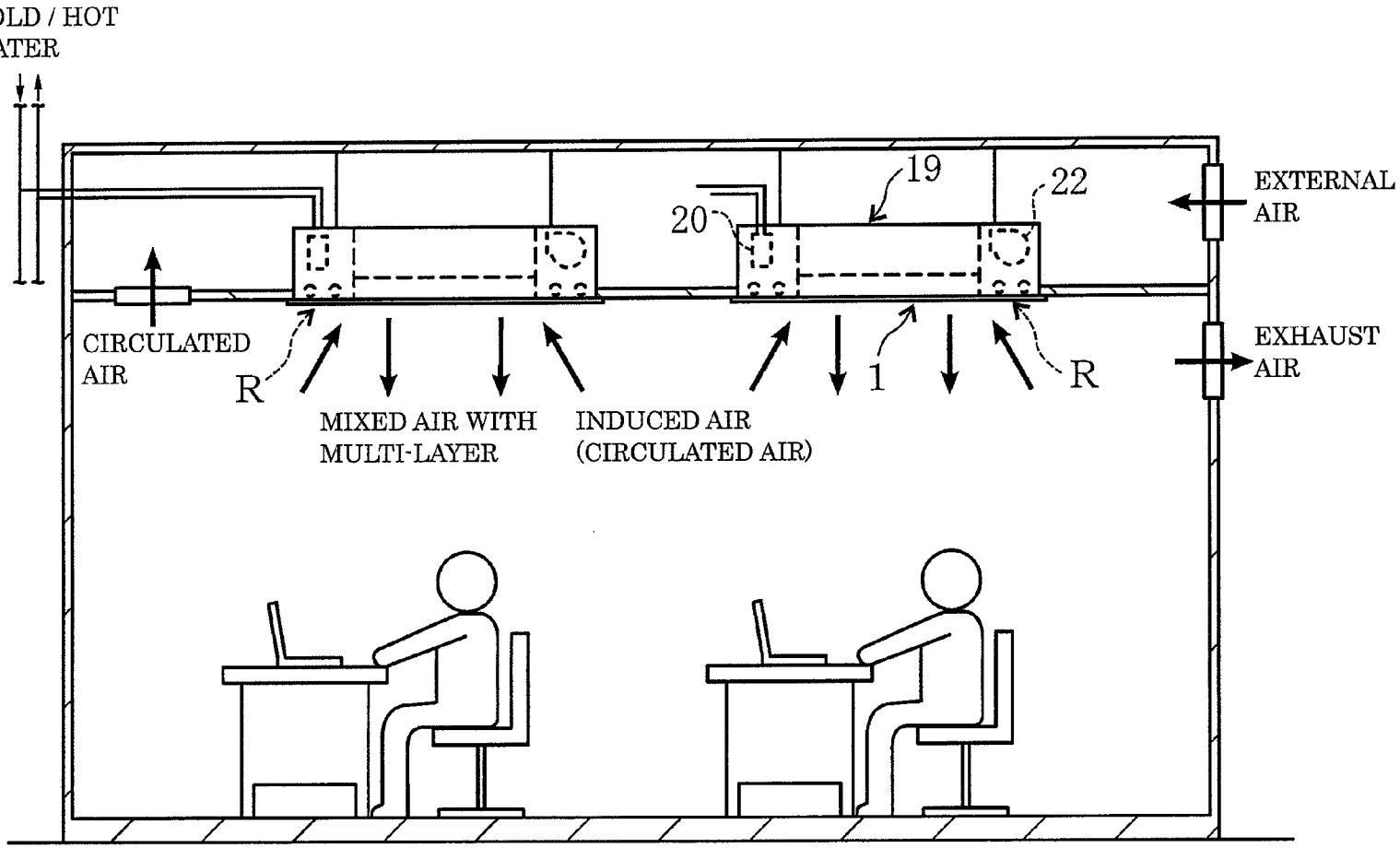
FIG. 14 is a brief explanatory view illustrating an example of usage of the induction emission air conditioning apparatus according to Embodiment 4 of the present invention.

FIG. 12 is a perspective view illustrating the case of installing an induction emission air conditioning apparatus according to Embodiment 4 of the present invention in a ceiling wherein a part of an upper face thereof is cut away, and viewed from the above, FIG. 13 is a perspective view of the induction emission air conditioning apparatus according to Embodiment 4 of the present invention viewed from a room inside side thereof, and FIG. 14 is a brief explanatory view illustrating an example of usage of the induction emission air conditioning apparatus according to Embodiment 4 of the present invention.

The induction emission air conditioning apparatus according to Embodiment 4 of the present invention is provided with the casing 19 buried in the ceiling C at the room inside S, and the inner side of the casing 19 is provided with the heat exchanger 20 through which the feed air induced from the outdoor side passes, and the fan 22 passing the feed air through the heat exchanger 20. Further, the inner side of the casing 19 is provided with the heating and cooling unit 1 for blowing the mixed air obtained by inducing and suctioning the air in the room inside S by the feed air passing through the heat exchanger 20 and mixing with the feed air to the room inside S in a laminar manner, and emitting the heat of the mixed air to the room inside S, and the lighting system R for lighting the room inside S. Further, the inner side of the casing 19 is provided with the air blowing path 24 communicating and coupling the heat exchanger 20, the fan 22 and the heating and cooling unit 1, the detector 28 such as a human sensing sensor or the like detecting existence, a position or the like of a human body in the room inside S so as to output a signal according to a detection result, and a controller 29 for controlling one or both of the air conditioning performance (increase/decrease or on and off of the air volume, the air blow-off temperature or the like) and the light modulation of the lighting system (increase/decrease or on and off of the illumination intensity) in response to the signal from the detector 28. It is to be noted that they are integrated. Since the induction emission air conditioning apparatus according to the present invention has the structure mentioned above, it can be easily installed even in a narrow back side of a ceiling.

The space in the back side of the ceiling C serves as a so-called ceiling chamber. In other words, the air in the back side (the ceiling chamber) of the ceiling C is passed through the heat exchanger 20 as the feed air. The feed air includes the processed external air in which temperature and humidity is controlled by an outside adjusting apparatus (not illustrated) or the like, the raw external air in which temperature and humidity is not controlled, the mixed air of the processed external air and the circulate air from the room inside S, the mixed air of the raw external air and the circulated air, the circulated air, or the like.

Further, the heat exchanger 20 is provided with the heat transfer pipe, and the heat transfer pipe is an elliptical pipe. As the heat exchanger 20, it is possible to utilize various systems such as a hot/cold water coil heat exchanging the air to be fed by the cold water or the hot water, a direct expanding coil heat exchanging the air to be fed by the refrigerant of the water heat source or the air heat source heat pump, and the like, and it is not limited to an illustrated example. In this case, in the drawing, reference numeral 31 denotes a drain pan.

The casing 19 is a flat rectangular parallelepiped shape which is formed into a rectangular shape in a plan view, and is provided with the induction port 30 in one side face for suctioning the feed air. The heat exchanger 20 is arranged in one, and the fan 22 carrying out the air blowing is arranged in the other, in both ends of the heating and cooling unit 1 which is formed into a rectangular shape in a bottom view.

The heating and cooling unit 1 within the casing 19 is formed into a flat rectangular parallelepiped shape in which a dimension in a short direction is slightly shorter than the casing 19, and is provided in such a manner that its longitudinal direction coincides with a longitudinal direction of the casing 19. It is to be noted that the lighting system R is provided in both end sides in the longitudinal direction of the heating and cooling unit 1. In other words, the lighting system R is arranged in a lower side of each of the heat exchanger 20 and the fan 22.

The air blowing path 24 is formed in the upper side of the heating and cooling unit 1. The air blowing path 24 has a windward side wind path 25 communicating and coupling the heat exchanger 20 and the fan 22, and a leeward side wind path 26 communicating and coupling the fan 22 and the heating and cooling unit 1.

The windward side wind path 25 and the leeward side wind path 26 are juxtaposed, and are structured in such a manner that the wind directions are reversed to each other. The feed air from the leeward side wind path 26 flows into the heating and cooling unit 1 via the air inlet 18. The air inlet 18 is formed in the upper face of the heating and cooling unit 1 in the vicinity of the heat exchanger 20 which is spaced from the fan 22. In other words, it is structured such that the air blowing distance of the feed air from the induction port 30 to the air inlet 18 becomes longer. In the illustrated example, the air blowing path 24 constructed by the windward side wind path 25 and the leeward side wind path 26 is constructed by comparting by the partition plate 21 with communication port and the duct member 23, however, the structure may be freely changed.

The feed air flows based on the drive of the fan 22, according to the order of induction port 30→heat exchanger 20→windward side wind path 25→fan 22→leeward side wind path 26→air inlet 18→heating and cooling unit 1. In the illustrated case, since the fan 22 and the induction port 30 back away, and the air blowing distance is long, a comfortable low noise operation can be achieved. In this case, these structures can be freely changed, and although an illustration is omitted, the structure may be made, for example such that the feed air is induced from the fan 22 side by changing the communication position between the windward side wind path 25 and the leeward side wind path 26 and the position of the induction port 30, and flows according to the order of fan 22→heat exchanger 20→heating and cooling unit 1.

Figure 15:
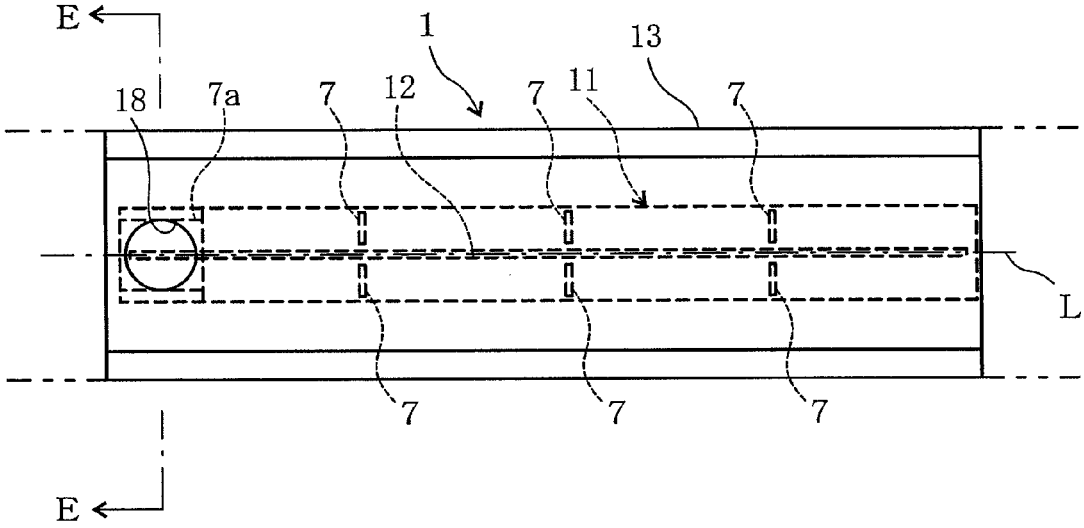
FIG. 15 is a plan view of a heating and cooling unit of the induction emission air conditioning apparatus according to Embodiment 4 of the present invention.

FIG. 15 is a plan view of the heating and cooling unit 1 of the induction emission air conditioning apparatus according to Embodiment 4 of the present invention. The heating and cooling unit 1 is provided with a hood 13, an adjustment case 11 for receiving the feed air and adjusting the flow of the feed air, and a mixer case 16 for mixing the adjusted air delivered from the adjustment case 11 with the circulated air from the room inside so as to feed to the room inside.

Figure 16:
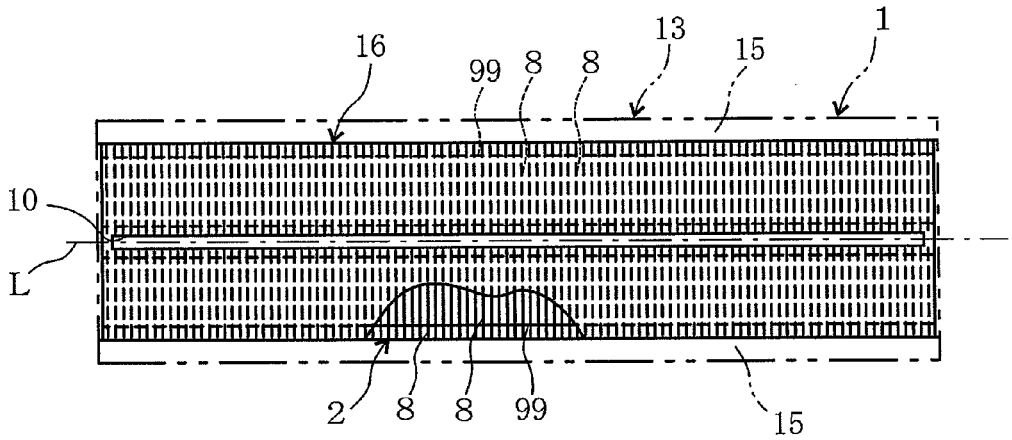
FIG. 16 is a plan view of a heating and cooling unit in the induction emission air conditioning apparatus according to Embodiment 4 of the present invention wherein a part of an upper face of a mixer case of a heating and cooling unit is cut away.
Figure 17:
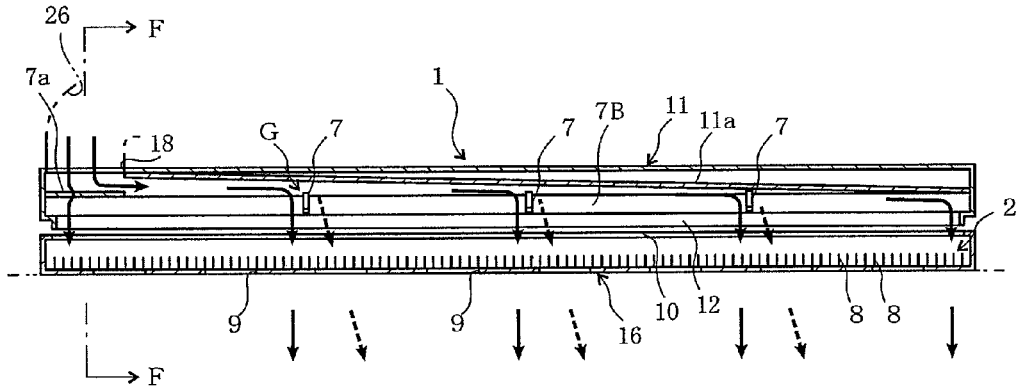
FIG. 17 is a sectional side view of an adjustment case and a mixer case of a heating and cooling unit in the induction emission air conditioning apparatus according to Embodiment 4 of the present invention.
Figure 18:
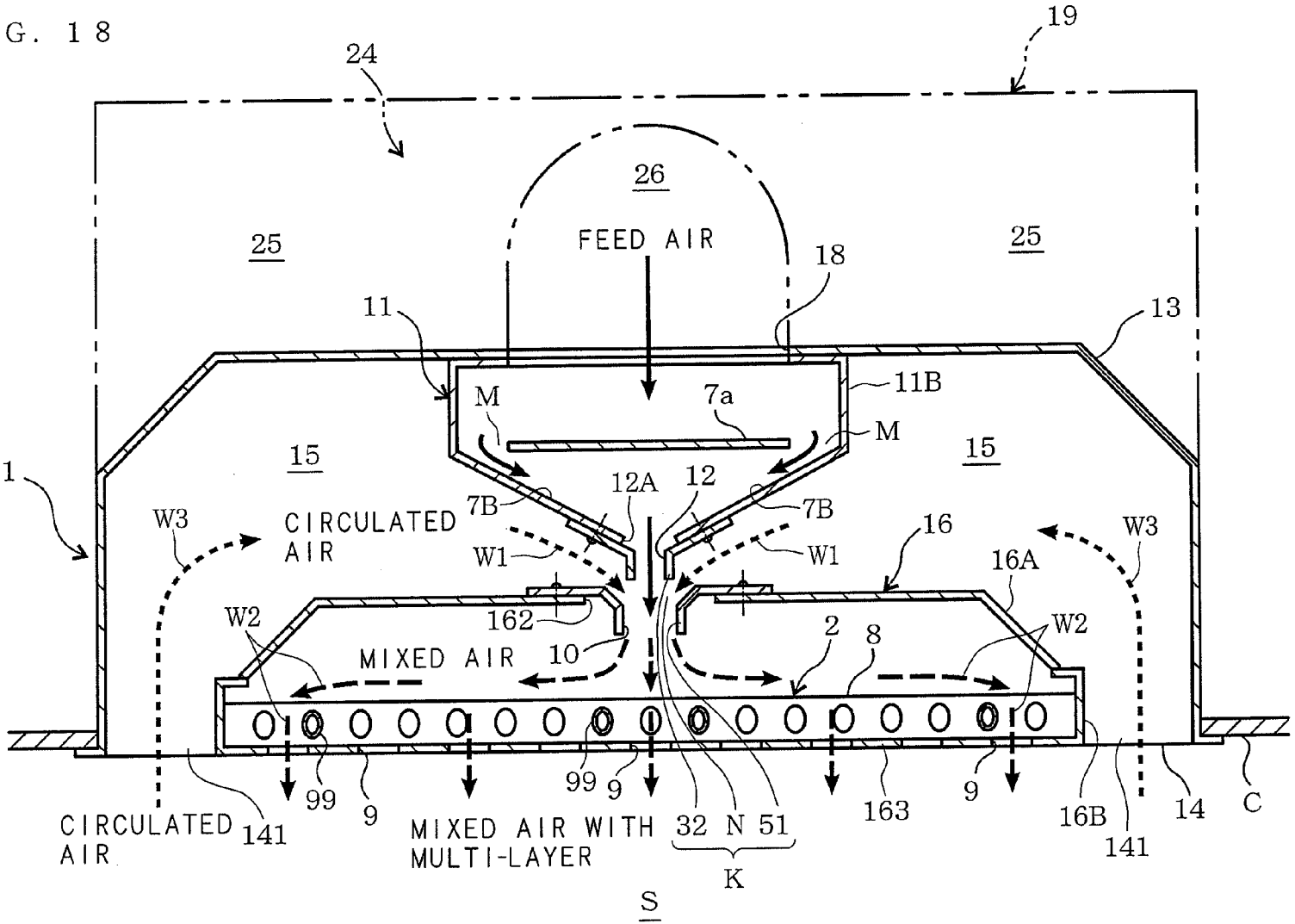
FIG. 18 is a sectional view of a whole viewed from the E direction of FIG. 15.
Figure 19:
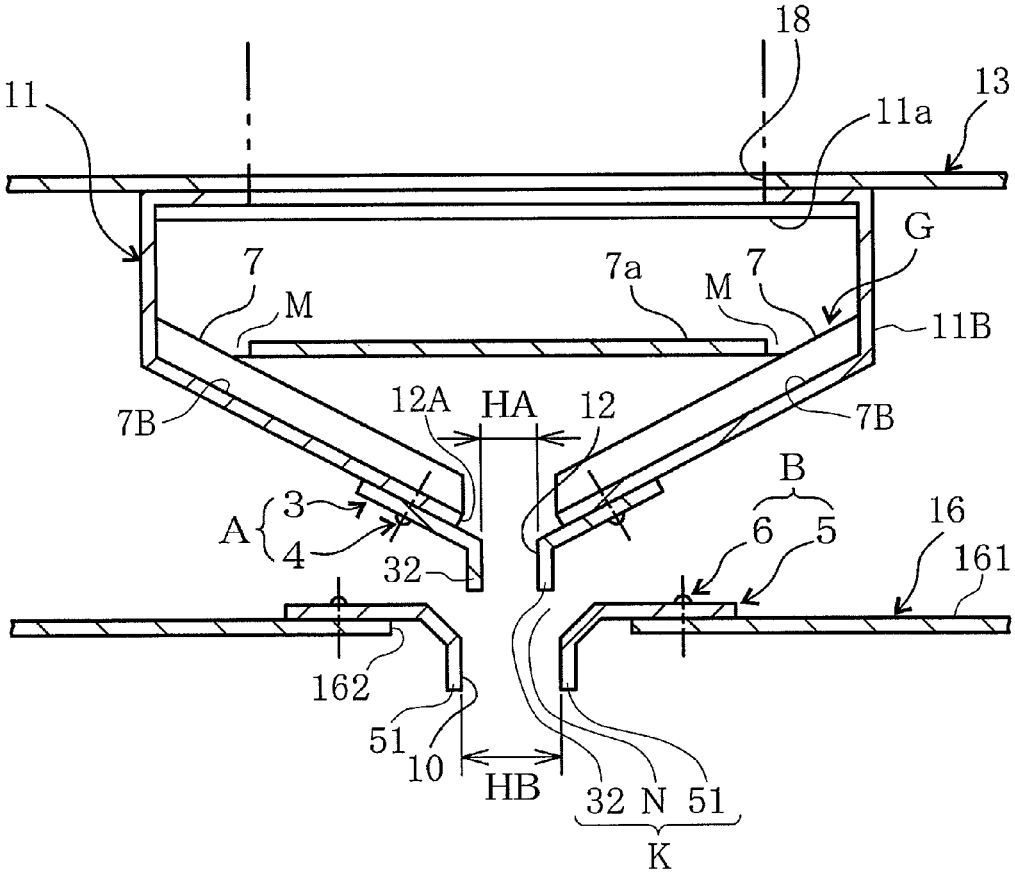
FIG. 19 is a sectional view for illustrating a main part of an adjustment case and a mixer case viewed from the F direction of FIG. 17.

FIG. 16 is a plan view of the heating and cooling unit 1 in the induction emission air conditioning apparatus according to Embodiment 4 of the present invention wherein a part of an upper face of the mixer case 16 of the heating and cooling unit 1 is cut away, FIG. 17 is a sectional side view of the adjustment case 11 and the mixer case 16 of the heating and cooling unit 1 in the induction emission air conditioning apparatus according to Embodiment 4 of the present invention, FIG. 18 is a sectional view of a whole viewed from the E direction of FIG. 15, and FIG. 19 is a sectional view for illustrating a main part of the adjustment case 11 and the mixer case 16 viewed from the F direction of FIG. 17.

The hood 13 of the heating and cooling unit 1 according to the present invention is provided in the casing 19, and the adjustment case 11 and the mixer case 16 are housed inside the hood 13.

The hood 13 is a flat rectangular parallelepiped box member having a lower opening part 14 in one face. The hood 13 is provided in such a manner that the one face having the lower opening part 14 is directed to the room inside S while being flush with the ceiling C.

Further, the adjustment case 11 is attached to the other face which is opposed to the one face of the hood 13, the mixer case 16 is arranged below the adjustment case 11 so as to be opposed to the adjustment case 11, and they are surrounded by the side wall of the hood 13. It is to be noted that a circulated air path 15 communicatively connecting the circulated air in the room inside S from the lower opening part 14 to the guide path K mentioned above is formed between the adjustment case 11 and the mixer case 16, and the inner side of the hood 13. In other words, the circulated air path 15 is communicatively connected with the room inside (the circulated air), and is structured such that the circulated air can always come in and out the circulated air path 15, and the circulated air is suctioned into the guide path K via the circulated air path 15.

The adjustment case 11 is provided with an air inlet 18 which is continuously provided in the air blowing path 24 so as to receive the feed air, a holder case part 11B which holds the feed air from the air inlet 18, and adjusts the flow such as the wind direction, the wind velocity, the air volume of the feed air, and a air blowoff port 12A which blows off the adjusted air having the flow adjusted by the holder case part 11B toward the outer side of the adjustment case 11. The air blowoff port 12A is formed into a rectangular shape, and is formed in a lower side of the holder case part 11B, and the adjustment case 11 is structured such as to be narrowed toward the air blowoff port 12A.

The holder case part 11B is a box member which has a taper shape which narrows toward a lower side, and extends along a longitudinal direction of the hood 13. The inner side of the holder case part 11B is provided with a plurality of small wall strip parts 7, 7, . . . 7 for guiding the feed air from the air inlet 18 to the air blowoff port 12A, and a inclined plate 11*a* for suppressing unevenness of the air volume and the wind velocity of the adjusted air blown out from the air blowoff port 12A.

Figure 20:
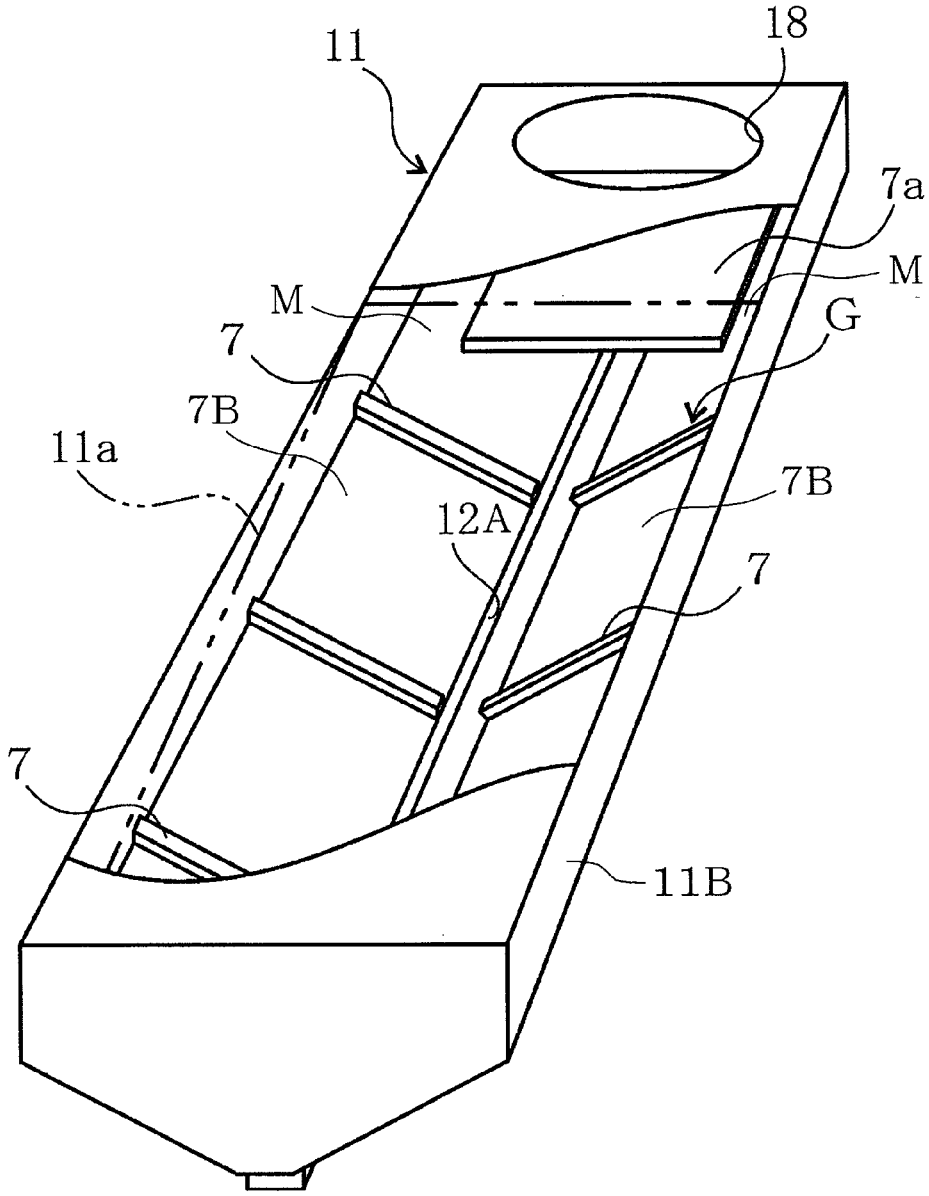
FIG. 20 is a perspective view of a heating and cooling unit in the induction emission air conditioning apparatus according to Embodiment 4 of the present invention wherein a part of an upper face of an adjustment case of a heating and cooling unit is cut away.

FIG. 20 is a perspective view of a heating and cooling unit in the induction emission air conditioning apparatus according to Embodiment 4 of the present invention wherein a part of an upper face of an adjustment case of a heating and cooling unit. The holder case part 11B is provided with two opposed inclined walls 7B and 7B which are inclined symmetrically, and the small wall strip parts 7, 7, . . . 7 are provided to protrude from the inside of the respective inclined walls 7B and 7B. The small wall strip parts 7, 7, . . . 7 have the rectangular shape, and are juxtaposed at an interval at the inclined walls 7B and 7B in a manner such that the longitudinal direction thereof is oriented to the vertical direction. When feed air from the air inlet 18 collides with the small wall strip parts 7, 7, . . . 7, the wind direction thereof is changed and the feed air can be guided toward the air blowoff port 12A.

The dimension (height) of the small wall strip parts 7, 7, . . . 7 in the protrusion direction and the dimension (width) thereof in a direction crossing the protrusion direction can be freely changed, though it is preferable to set the vertical cross section of the small wall strip parts 7, 7, . . . 7 to be 10-30% of the maximum cross section in the direction of the shorter side of the adjustment case 11. This is because the wind direction cannot be adjusted when the height of the small wall strip parts 7, 7, . . . 7 is too low, while feed air from the air inlet 18 cannot reach the leeward part of the small wall strip parts 7, 7, . . . 7 as indicated by the bold dot-line arrows of FIG. 17 and a part where air does not flow is generated intermittently in a space between the bold dot-line arrows and the bold full-line arrows when the height is too high. It is to be noted that the full-line arrows in FIG. 17 indicate the wind direction to be generated by the small wall strip parts 7, 7, . . . 7 regardless of the height.

In other words, in the heating and cooling unit 1 according to Embodiment 4 of the present invention, a rectifier structure G composed of the inner face of the inclined walls 7B, 7B and the small wall strip parts 7, 7, . . . 7 is provided at the adjustment case 11. The feed air entering from the air inlet 18 is guided by the rectifier structure G or more specifically, the wind direction thereof is changed to vertically downward by resistance of the inner face of the inclined walls 7B, 7B and the small wall strip parts 7, 7, . . . 7, so that the feed air flows toward the air blowoff port 12A.

The inclined plate 11*a* has a rectangular plate shape which is extended along the longitudinal direction of the holder case part 11B. The inclined plate 11*a* is located to be opposed to the air blowoff port 12A in a manner such that the distance from the air blowoff port 12A gradually changes along the longitudinal direction. More specifically, the inclined plate 11*a* is attached to be inclined downward, that is, in a manner such that the distance from the air blowoff port 12A is the largest in the vicinity of the air inlet 18 and gradually decreases with increase in the distance from the air inlet 18. Accordingly, it is possible to prevent occurrence of ununiformity in the air pressure between an area near to the air inlet 18 and an area far from the air inlet 18 in the holder case part 11B and to suppress unevenness of the air volume and the wind velocity of adjusted air to be blown from the air blowoff port 12A.

A partition plate 7*a* for guiding feed air from the air inlet 18 in the longitudinal direction of the adjustment case 11 is provided directly below the air inlet 18. The partition plate 7*a* is located to be opposed to the air inlet 18, and a clearance M is provided between the partition plate 7*a* and the inclined walls 7B, 7B. Accordingly, most of feed air entering from the air inlet 18 collides with the partition plate 7*a*, the wind direction thereof is changed to the longitudinal direction of the adjustment case 11, and only a part flows through the clearance M toward the air blowoff port 12A.

It is to be noted that the present invention is not limited to the example explained in Embodiment 4 of the present invention wherein the adjustment case 11 has a funnel-shaped cross section (or taper shape) narrowing toward the air blowoff port 12A having a wide upper part and a thinned lower part as described above.

The mixer case 16 is the same as the mixer case 16 according to Embodiment 1 illustrated in FIG. 6. More particularly, the mixer case 16 according to Embodiment 4 is formed into the flat box shape, is detachably mounted in the hood 13, and is provided with an mounting part 16B to which the heat storage radiation flow divider 2 mentioned above is attached, and a cover part 16A for covering the mounting part 16B, and the cover part 16A and the mounting part 16B are formed in an integrated manner (hereinafter, see FIG. 6).

The mounting part 16B is a flat rectangular parallelepiped box member in which one upper face is open. The heat storage radiation flow divider 2 for obtaining low heat or high heat from the mixed air so as to radiate heat toward the room inside is provided in the inner side of the other face 163 at the lower side opposed to the one face of the mounting part 16B so as to be thermally conducted with the mounting part 16B (and cover part 16A). Accordingly, heat stored in the heat storage radiation flow divider 2 is transferred to the mounting part 16B and the cover part 16A, and radiation heat (low heat or high heat) can reach a long-distance point with high efficiency by carrying out radiation cooling or radiation heating to the room inside S not only by the heat storage radiation flow divider 2 but also by the mounting part 16B and the cover part 16A.

Moreover, a plurality of apertures 9, 9, . . . 9 for blowing the mixed air to the outside (room inside S) are provided at the other face 163 of the mounting part 16B. The apertures 9, 9, . . . 9 are long holes which penetrate the mixer case 16 (mounting part 16B) from the inside thereof to the outside thereof. Mixed air in the mixer case 16 passes the heat storage radiation flow divider 2 and the apertures 9, 9, . . . 9, and is supplied to the room inside. The present invention is not limited to the example explained in Embodiment 4 of the present invention wherein the apertures 9, 9, . . . 9 are long holes, and the apertures 9, 9, . . . 9 may have a shape such as a round shape or a rectangular shape. Moreover, the arrangement, the number or the like of the apertures 9, 9, . . . 9 may be changed as occasion rises.

It is to be noted that it is preferable to set the total area ratio of the whole area of the apertures 9, 9, . . . 9 to the whole area of the other face 163 of the mixer case 16 (mounting part 16B) equal to or larger than 30% in order to maximize the radiation heating action of the heat storage radiation flow divider 2 and the mixer case 16 to the room inside S and the heat transfer action by mixed air emission from the mixer case 16, though the present invention is not limited to this.

The heat storage radiation flow divider 2 comprises: a plurality of heat transfer plates 8, 8, . . . 8; and a plurality of elliptical heat storage pipes 99, 99, . . . 99 for storing low heat or high heat transferred from the heat transfer plates 8, 8, . . . 8. The heat transfer plates 8, 8, . . . 8 have a rectangular shape, obtain low heat or high heat from the mixed air, and transfer heat to the mounting part 16B, the cover part 16A and the elliptical heat storage pipes 99, 99, . . . 99. The elliptical heat storage pipes 99, 99, . . . 99 have an elliptical longitudinal section, and are attached in a manner such that the major axis direction of the ellipse is oriented to the vertical direction. Accordingly, mixed air in the mixer case 16 can pass the heat storage radiation flow divider 2 smoothly with a low pressure loss.

The heat transfer plates 8, 8, . . . 8 are made of, for example, aluminum, copper, mica, titanium, Carbolite or the like having high thermal conductivity and high thermal emissivity, and are juxtaposed to be opposed to each other at a proper interval in the direction of the shorter side of the mounting part 16B. The elliptical heat storage pipes 99, 99, . . . 99 are installed so as to penetrate the heat transfer plates 8, 8, . . . 8 in the juxtaposition direction of the heat transfer plates 8, 8, . . . 8. It is to be noted that the elliptical heat storage pipes 99, 99, . . . 99 are made of copper, mica, titanium, Carbolite or the like and are juxtaposed along the longitudinal direction of the heat transfer plates 8, and the heat storage radiation flow divider 2 has a flat rectangular parallelepiped shape as a whole, similar to the inner shape of the mounting part 16B.

With such a structure, the wind velocity of mixed air in the mixer case 16 to pass the heat storage radiation flow divider 2 is decreased by the heat transfer plates 8, 8, . . . 8, the flow of the mixed air is divided into a plurality of layers and the mixed air is supplied to the room inside S in a so-called laminar manner, and therefore it is possible to suppress the draft to be given to the user of the room inside S.

It is to be noted that the present invention is not limited to the example explained in the present embodiment wherein a plurality of elliptical heat storage pipes 99, 99, . . . 99 are provided, and one long elliptical heat storage pipe 99 may be folded to have a meandering shape. Moreover, the elliptical heat storage pipes 99, 99, . . . 99 may have not an elliptical cross section but a circular cross section.

Moreover, the structure of the elliptical heat storage pipes 99, 99, . . . 99 is not limited to the above description. A heat storage member T for obtaining heat of the mixed air via the elliptical heat storage pipes 99, 99, . . . 99 and storing the heat is filled in the elliptical heat storage pipes 99, 99, . . . 99. The heat storage member T needs only to be made of material which can store heat and release heat for a long period of time, and may be in a liquid state or a solid state.

Moreover, the shape, the number, the pitch and the like of the heat transfer plates 8, 8, . . . 8 and the apertures 9, 9, . . . 9 are set in a manner such that the velocity of mixed air before passing the heat storage radiation flow divider 2 is decreased to be equal to or lower than half of the velocity of mixed air after passing the heat storage radiation flow divider 2, or more preferably equal to or lower than 20% to 30%, in order to ensure an optimum function of flow division, diffusion, heat transfer action and the like of mixed air to the room inside S.

On the other hand, the cover part 16A is provided to cover the one face of the mounting part 16B at the upper side. The cover part 16A has a shape to be obtained by folding an outer edge of an upper plate 161, which is made of a rectangular plate material having a size substantially equal to the heat storage radiation flow divider 2, downward and extending the same. Accordingly, a space surrounded by the inner face of the cover part 16A and the heat storage radiation flow divider 2 is formed in the mixer case 16. In the space, adjusted air from the adjustment case 11 and circulated air from the circulated air path 15 are mixed by a method described above, and become mixed air (see the description of FIG. 5).

Moreover, in the cover part 16A, an induction port (air suction port) 162 for suctioning adjusted air from the adjustment case 11 and inducing and suctioning circulated air from the circulated air path 15 is provided at a central part (denoted by L in FIG. 16) in the direction of the shorter side of the upper plate 161. The induction port 162 has a rectangular shape elongated in the longitudinal direction of the upper plate 161 and is formed to be opposed to the air blowoff port 12A of the adjustment case 11. It is to be noted that the induction port 162 is formed at the midpoint between two opposed side faces of the upper plate 161 in the lateral direction and constructed to be matched with the air blowoff port 12A. It is to be noted that the circulated air path 15 is formed outside the two side faces and the upper plate 161.

Further, the heating and cooling unit 1 according to the present invention is provided with the air blowoff guide 12 which is attached in the vicinity of the air blowoff port 12A of the adjustment case 11, and the induction guide 10 which is arranged so as to be opposed to the air blowoff guide 12 with the space N being sandwiched therebetween, and is attached in the vicinity of the induction port 162 of the mixer case 16.

The air blowoff guide 12 is attached to a lower end part of the inclined walls 7B, 7B of the adjustment case 11 in the vicinity of the air blowoff port 12A, and guides the wind direction of adjusted air blown from the air blowoff port 12A to flow into the induction port 162. Moreover, the air blowoff guide 12 comprises an air volume adjustment structure A for adjusting the air volume of the adjusted air. The air volume adjustment structure A is composed of: a pair of air blowoff port air volume adjustment members 3, 3 attached to the outer side of a lower end part of the inclined walls 7B, 7B so as to be slidable; and screw members 4, 4 for fixing the air blowoff port air volume adjustment members 3, 3 so as to be slidable.

The air blowoff port air volume adjustment members 3, 3 are made of rectangular plate materials having a longitudinal dimension substantially equal to the longitudinal dimension of the air blowoff port 12A. An upper end part of each of the air blowoff port air volume adjustment members 3, 3 in the lateral direction is fixed at an edge part at each long side of the air blowoff port 12A by each of the screw members 4, 4 so as to be slidable, and a lower end part of each of the air blowoff port air volume adjustment members 3, 3 is folded and extended toward the induction port 162 to form each of guide flanges 32, 32.

For example, a long through hole is provided at an upper end part of each of the air blowoff port air volume adjustment members 3, 3, and each air blowoff port air volume adjustment member 3 is fixed by a screw member 4, such as a screw or a rivet, having a diameter equal to the minor axis of the long through hole so as to be slidable in the major axis direction of the long through hole. The air volume of adjusted air to be blown from the air blowoff port 12A can be adjusted when the pair of air blowoff port air volume adjustment members 3, 3 slide respectively along the outer face of the inclined walls 7B, 7B in the incline direction thereof so as to open or close the air blowoff port 12A, that is, when the interval (HA) between the air blowoff port air volume adjustment members 3, 3 increases or decreases. It is to be noted that adjusted air to be blown from the air blowoff port 12A exits the air blowoff port 12A and then the wind direction thereof is guided by the guide flanges 32, 32. That is to say, the air blowoff guide 12 functions to adjust the air volume of the adjusted air and to guide the adjusted air.

The induction guide 10 is attached to a central part of the upper plate 161 in the vicinity of the induction port 162 and guides adjusted air to be blown from the air blowoff port 12A so as to be suctioned into the induction port 162 and guides circulated air from the circulated air path 15 so as to be induced and suctioned. The induction guide 10 is located to be opposed to the air blowoff guide 12 across the space N as described above.

Moreover, the induction guide 10 comprises an air volume adjustment structure B for adjusting the volume of air to be suctioned. The air volume adjustment structure B is composed of: a pair of induction port air volume adjustment members 5, 5 attached to the outer side of the upper plate 161 so as to be slidable; and screw members 6, 6 for fixing the induction port air volume adjustment members 5, 5 so as to be slidable.

The induction port air volume adjustment members 5, 5 are made of rectangular plate materials having a longitudinal dimension substantially equal to the longitudinal dimension of the induction port 162. An outer end part of the central part at the outer side in the direction of the shorter side of each of the induction port, air volume adjustment members 5, 5 is fixed at an edge part at each long side of the induction port 162 by each of the screw members 6, 6 so as to be slidable. Moreover, an inner end part of each of the induction port air volume adjustment members 5, 5 is folded and extended toward the inner side of the mixer case 16 so as to form each of the guide flanges 51, 51.

For example, a long through hole is provided at an outer end part of each of the induction port air volume adjustment members 5, 5, and each induction port air volume adjustment member 5 is fixed by a screw member 6, such as a screw or a rivet, having a diameter equal to the minor axis of the long through hole so as to be slidable in the major axis direction of the long through hole. The volume of air to be suctioned into the induction port 162 can be adjusted when the pair of induction port air volume adjustment members 5, 5 slide respectively along the outer face of the upper plate 161 so as to open or close the induction port 162, that is, when the interval (HB) between the induction port air volume adjustment members 5, 5 increases or decreases. It is to be noted that the wind direction of air, which passes the induction port 162, is guided by the guide flanges 51, 51.

Further, the heating and cooling unit 1 according to the present invention forms the guide path K for guiding the adjusted air blown out from the air blowoff port 12A of the adjustment case 11 to the mixer case 16. The guide path K includes a part of the air blowoff guide 12 (or the air blowoff port air volume adjustment member 3), and a part of the induction guide 10 (or the induction port air volume adjustment member 5). More particularly, the guide path K is constructed, by the guide flange 32 of the air blowoff guide 12 (or the air blowoff air volume adjustment member 3), the space N, and the guide flange 51 of the induction guide 10 (or the induction port air volume adjustment member 5), and the adjusted air blown off from the air blowoff port 12A is guided by the guide path K, and flows into the induction port 162. At this time, the circulated air from the room inside S is suctioned into the induction port 162 through the guide path K from the space N via the circulated air path 15.

In Embodiment 4 according to the present invention, the description is given of the case that the lower end part of the air blowoff port air volume adjustment member 3 and the inner end part of the induction port air volume adjustment member 5 are formed into the folded shape as the example, however, it is not limited to this. In this case, the structure may be made such that any one of the air blowoff guide 12 and the induction guide 10 is omitted.

On the other hand, the magnitude of the other face 163 of the mounting part 16B is smaller than the magnitude of the lower opening part 14 of the hood 13, and a clearance 141 is formed between the lower opening part 14 of the hood 13 and the other face 163 of the mounting part 16B. The circulated air from the room inside S passes through the clearance 141 and is suctioned into the circulated air path 15.

Figure 21A:
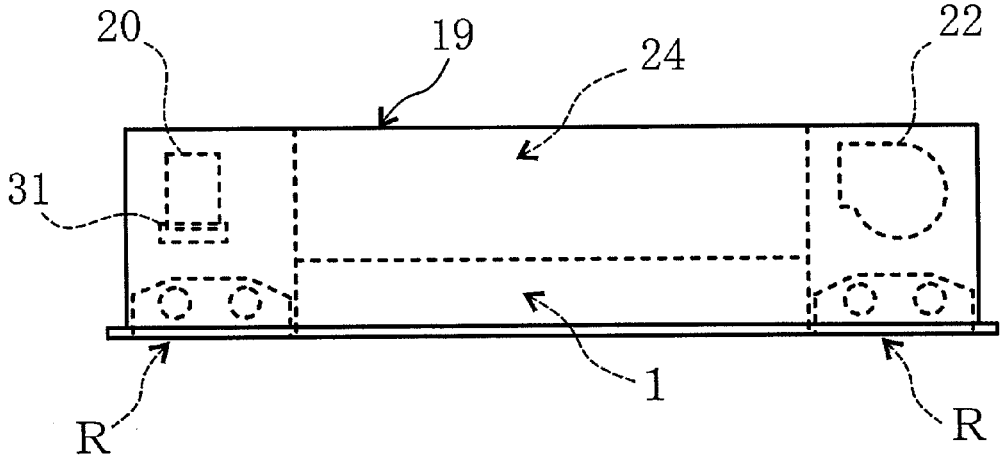
FIG. 21 is a brief side view illustrating an example of attachment and detachment of a lighting system of the heating and cooling unit, in the induction emission air conditioning apparatus according to Embodiment 4 of the present invention.
Figure 21B:
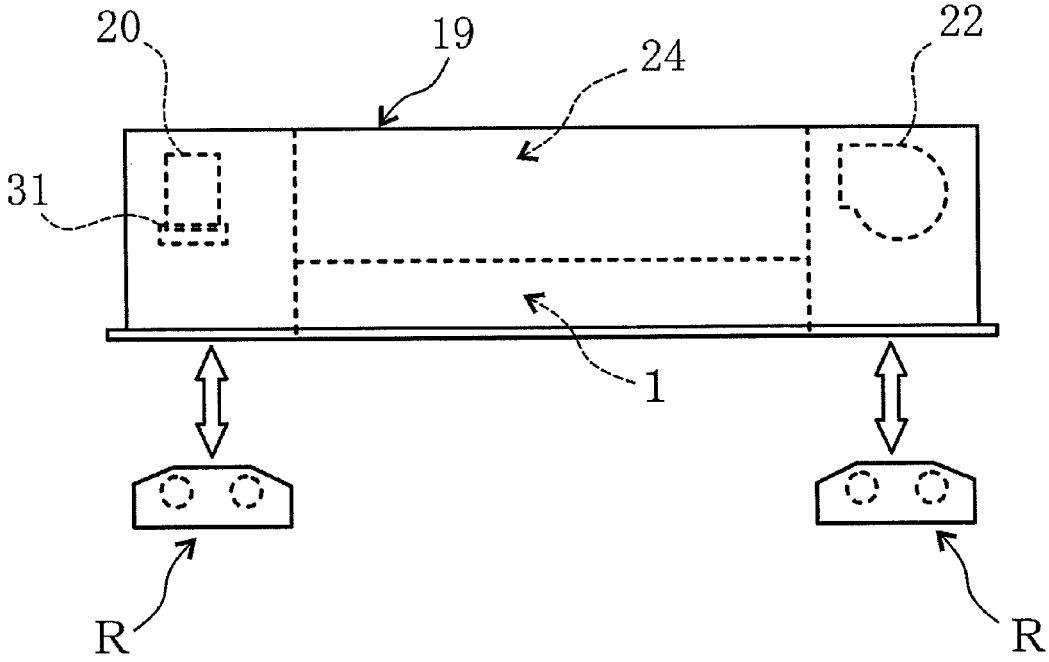
Figure 22:
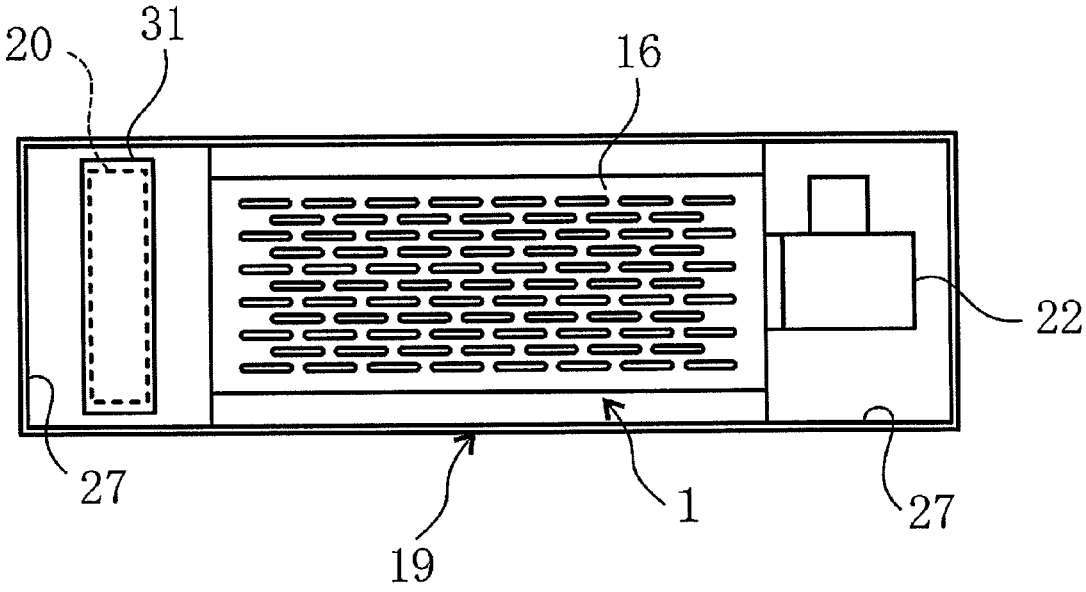
FIG. 22 is a bottom view of the induction emission air conditioning apparatus according to Embodiment 4 of the present invention wherein a lighting system is detached, and viewed from the room inside side.

FIG. 21 is a brief side view illustrating an example of attachment and detachment of a lighting system R of the heating and cooling unit 1, in the induction emission air conditioning apparatus according to Embodiment 4 of the present invention, and FIG. 22 is a bottom view of the induction emission air conditioning apparatus wherein the lighting system S is detached, and viewed from the room inside side.

The casing 19 is provided with an opening part 27 such that it is possible to face the heat exchanger 20 and the fan 22 from the room inside S by removing its lower face. And the lighting system R is provided in such a manner as to be freely opened and closed or be detachable via the opening part 27.

As mentioned above, the lighting system R is provided in each of both end sides in the longitudinal direction of the heating and cooling unit 1 in the vicinity of the clearance 141. In other words, it is structured such that a part of the circulated air comes into contact with the lighting system R when it passes through the clearance 141. Accordingly, the circulated air obtains the heat generated by the lighting system R, at a time of passing through the clearance 141. The obtained heat is used for reheating or preheating in the mixing of the feed air and the circulated air. In other words, at the time of cooling with a large cooling capacity per unit air volume of the feed air (when the air supply temperature is lowered than usual), heat from the lighting system R is used for reheating of feed air and therefore it is possible to prevent dew condensation reliably and to further decrease the air supply volume of feed air so as to further reduce the cost. Moreover, at the time of heating, heat from the lighting system R is used for preheating of feed air and therefore it is possible to decrease the capacity of a device for feeding the feed air and to enhance the heating capacity.

The lighting system R is, for example, a fluorescent tube, an incandescent lamp or an LED, and the number, the position thereof or the like can be changed in a proper manner.

Identical codes are used to refer to parts identical to those of Embodiment 4, and detailed explanation thereof will be omitted.

(Embodiment 5)

A heating and cooling unit 1 of an induction emission air conditioning apparatus according to Embodiment 5 is provided with short tubular protrusions 98, 98, 98, . . . 98 formed to protrude from one face of each heat transfer plate 8 (see FIGS. 10 and 11).

A plurality of protrusions 98, 98, 98, . . . 98 are juxtaposed at one face of each heat transfer plate 8 at a proper interval along the longitudinal direction of the heat transfer plate 8. More particularly, apertures 9 are juxtaposed below the respective protrusions 98 at a predetermined interval as illustrated in FIG. 10. The protrusions 98 have an elliptical cross section and are provided in a manner such that the major axis direction of the ellipse is oriented to the vertical direction. Moreover, the protrusions 98, 98, 98, . . . 98 are further juxtaposed in the juxtaposition direction of the heat transfer plates 8, 8, 8, . . . 8 with each central axis thereof being positioned on the same line.

The protrusions 98 have heat storage capability, and obtain heat from mixed air via the heat transfer plates 8, store the heat and radiate the heat toward the room inside S. A protrusion 98 of one heat transfer plate 8 is extended to come into contact with another adjacent heat transfer plate 8 and supports the adjacent heat transfer plate 8 so as to prevent warping of the adjacent heat transfer plate 8.

The action of the protrusion 98 is as mentioned above, and a detailed description thereof will be omitted.

In Embodiment 5, the description is given of the case that the protrusion 98 of one heat transfer plate 8 is extend to come into contact with another adjacent heat transfer plate 8 as the example, however, the structure is not limited to this, a protrusion 98 of one heat transfer plate 8 may be extended in a proper manner to the vicinity of another adjacent heat transfer plate 8. Further, the protrusion 98 may be formed integrally with the heat transfer plate 8, and may be structured detachably.

Further, in Embodiment 5, the description is given of the case that the protrusion 98 is formed into the elliptical shape as the example, however, it is not limited to this, but may be formed into a circular shape or a polygonal shape.

Identical codes are used to refer to parts identical to those of Embodiment 4, and detailed explanation thereof will be omitted (Embodiment 6)

Figure 23:
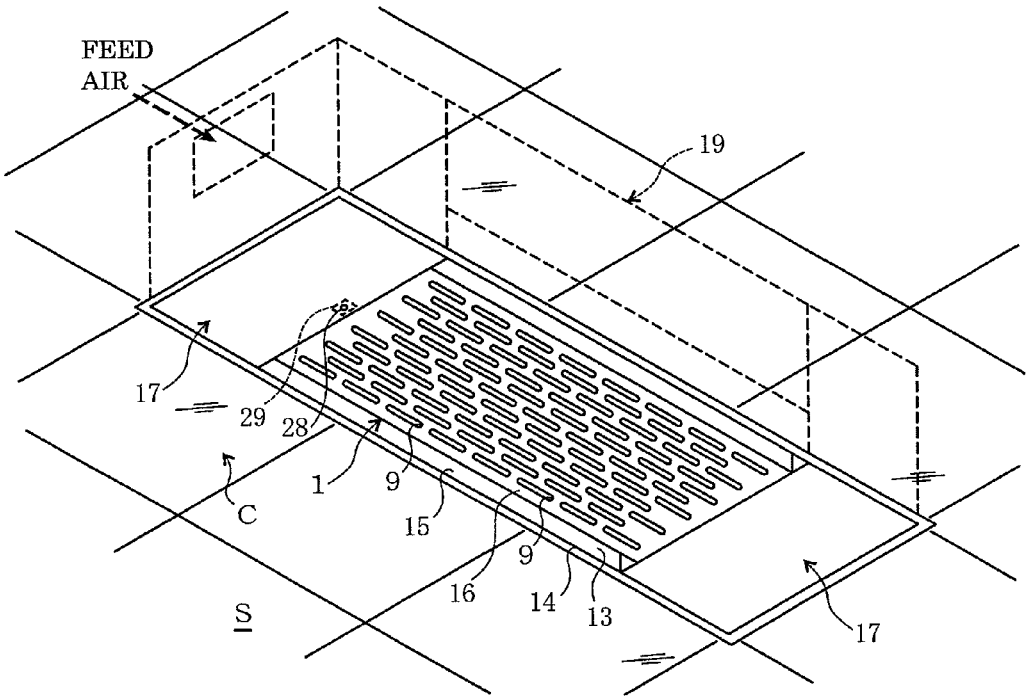
FIG. 23 is a perspective view of an induction emission air conditioning apparatus according to Embodiment 6 of the present invention viewed from a room inside.

FIG. 23 is a perspective view of an induction emission air conditioning apparatus according to Embodiment 6 of the present invention viewed from a room inside. In Embodiment 6, a maintenance and inspection panel 17 is provided in both end sides in a longitudinal direction of the heating and cooling unit 1, in the opening part 27 of a casing 19 so as to be freely opened and closed or be detachable. Accordingly, at a time of maintaining and inspecting, a maintenance and inspection work can be carried out by detaching the panel 17. It is to be noted that the structure may be made such that the lighting system R is omitted by making the panel 17 with an opaque material, or the structure may be made such that the lighting system R is provided in an upper side of the panel 17 by making the panel 17 with a transparent material.

Further, any one panel 17 is provided with the detector 28, and the controller 29 for controlling an air conditioning capacity or light modulation of a lighting system in response to a signal from the detector 28. Identical codes are used to refer to parts identical to those of Embodiment 4, and detailed explanation thereof will be omitted.

(Embodiment 7)

Figure 24:
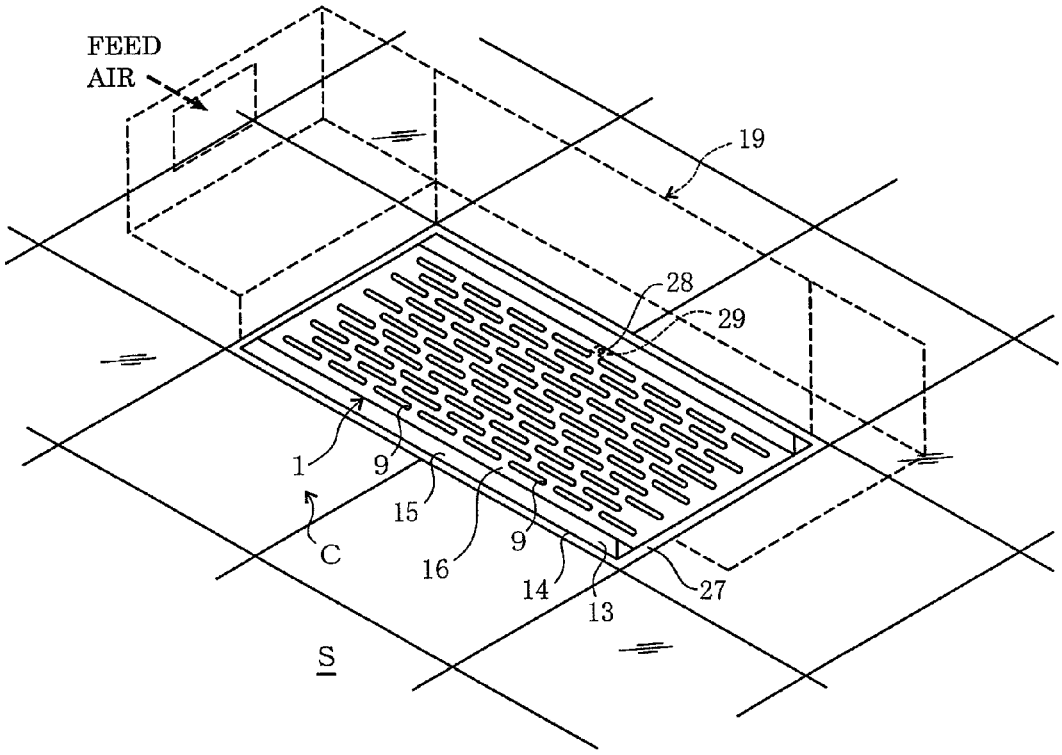
FIG. 24 is a perspective view of an induction emission air conditioning apparatus according to Embodiment 7 of the present invention viewed from a room inside.

FIG. 24 is a perspective view of an induction emission air conditioning apparatus according to Embodiment 7 of the present invention viewed from a room inside S. Embodiment 7 is structured by omitting the panel 17 according to Embodiment 6. More particularly, the panel 17 (and the lighting system R) according to Embodiment 6 are omitted, and the opening part 27 of the casing 19 is provided in such a manner that a magnitude thereof becomes to a magnitude which is approximately equal to the lower opening part 14 of the heating and cooling unit 1. Accordingly, the part which is exposed to the room inside S via the ceiling C is reduced in addition to the more simple structure, and an outer appearance from the room inside S becomes better.

Identical codes are used to refer to parts identical to those of Embodiment 4, and detailed explanation thereof will be omitted.

(Embodiment 8)

Figure 25:
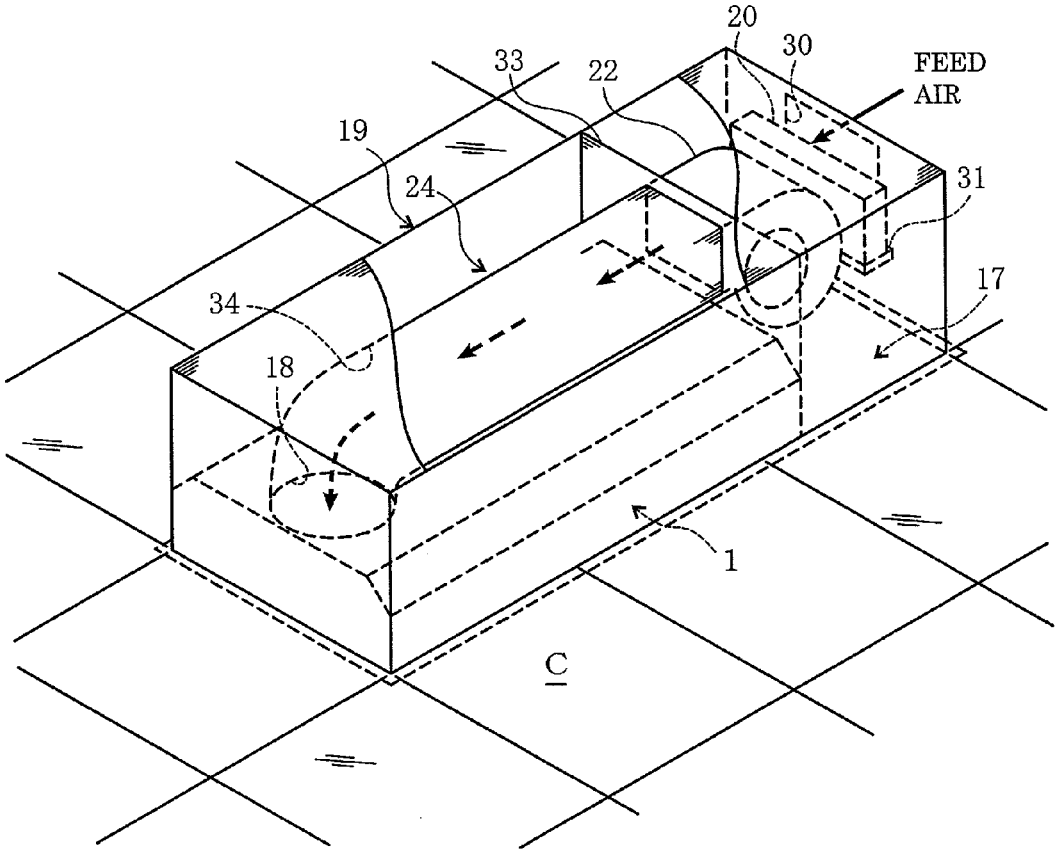
FIG. 25 is a perspective view of an induction emission air conditioning apparatus according to Embodiment 8 of the present invention wherein a part of an upper face of a casing is cut away, and viewed from the above.
Figure 26:
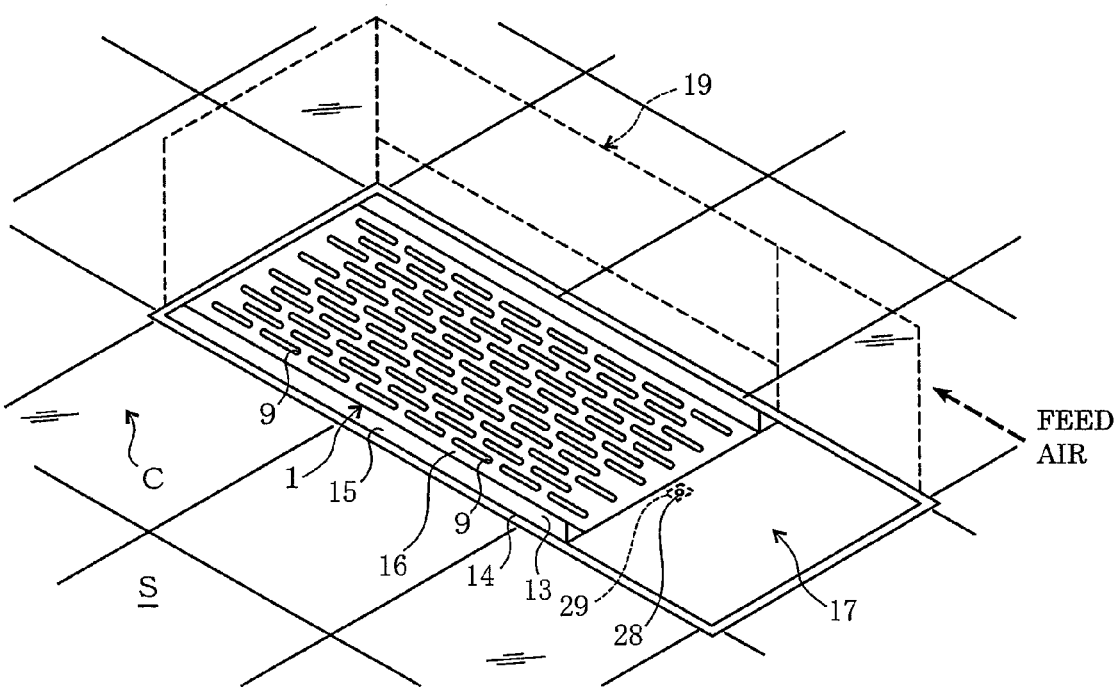
FIG. 26 is a perspective view of an induction emission air conditioning apparatus according to Embodiment 8 of the present invention viewed from a room inside.

FIG. 25 is a perspective view of an induction emission air conditioning apparatus according to Embodiment 8 of the present invention wherein a part of an upper face of the casing 19 is cut away, and viewed from the above, and FIG. 26 is a perspective view of an induction emission air conditioning apparatus according to Embodiment 8 of the present invention viewed from a room inside S.

The induction emission air conditioning apparatus according to Embodiment 8 of the present invention is structured such that the heat exchanger 20 and the fan 22 are arranged collectively in any one of both ends of the heating and cooling unit 1, and a air blowing path 24 communicating and coupling the heat exchanger 20 and the fan 22, and the heating and cooling unit 1 is provided on the heating and cooling unit 1 within the casing 19. The air blowing path 24 is constructed by a partition plate 33 with communication port coupled to the fan 22, and a duct-shaped member 34 communicatively connected with the fan 22 via the partition plate 33 with communication port.

Further, the air inlet 18 making the feed air flow into the heating and cooling unit 1 is provided in the vicinity of the other in both ends of the heating and cooling unit 1, and is structured such that a air blowing distance of the feed air becomes longer.

In FIGS. 25 and 26, there is exemplified the case that the air blowing path 24 is constructed by comparting the inner face of the casing 19 by the partition plate 33 with communication port and the duct-shaped member 34, however, the structure is not limited to this, but may be freely changed variously, for example, the duct-shaped member 34 is omitted, and the inner face of the casing 19 in the upper side of the heating and cooling unit 1 is formed as the air blowing path. Since the other structures are the same as those of Embodiment 4, a description thereof will be omitted.

In the induction emission air conditioning apparatus according to Embodiment 8, the feed air flows based on the drive of the fan 22 according to the order of induction port 30→heat exchanger 20→fan 22→air blowing path 24→air inlet 18 of heating and cooling unit 1, and the room inside S is air conditioned by the laminar mixed air and emission from the heating and cooling unit 1.

Identical codes are used to refer to parts identical to those of Embodiment 4, and detailed explanation thereof will be omitted.

(Embodiment 9)

Figure 27:
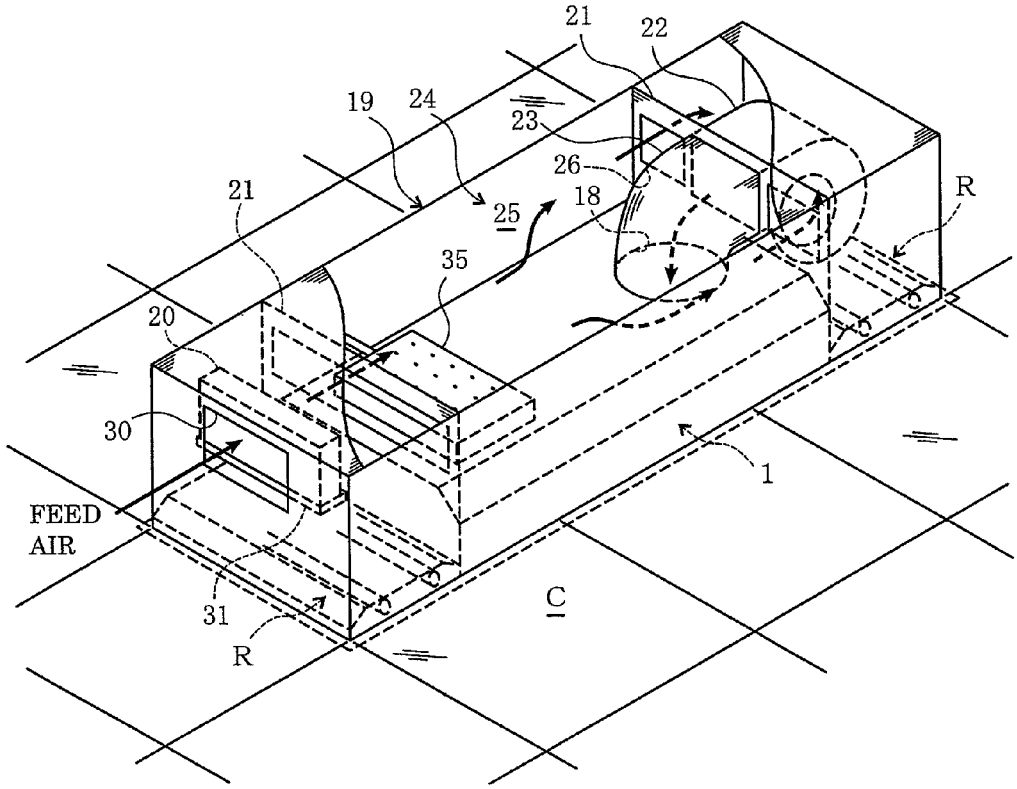
FIG. 27 is a perspective view of an induction emission air conditioning apparatus according to Embodiment 9 of the present invention wherein a part of an upper face of a casing is cut away, and viewed from the above.

FIG. 27 is a perspective view of an induction emission air conditioning apparatus according to Embodiment 9 of the present invention wherein a part of an upper face of a casing 19 is cut away, and viewed from the above. The induction emission air conditioning apparatus according to Embodiment 9 is structured such that a steam type humidifier 35 is provided in the vicinity of the heat exchanger 20 in an upper side of the heating and cooling unit 1. In other words, the structure is made such that the humidifier 35 is arranged within the air blowing path 24 (the windward side wind path 25), and the air blowing path 24 (the windward side wind path 25) is used for a humidifying space of the feed air. The steam is delivered from a steam generator (not illustrated) to the humidifier 35 so as to be sprayed into the air blowing path 24, and the feed air flowing into through the heat exchanger 20 is humidified.

Further, as is different from the case of Embodiment 4, the air inlet 18 is provided in the vicinity of the fan 22. Accordingly, the windward side wind path 25 becomes wide, and the humidifier 35 can be provided. Further, the heat exchanger 20 and the fan 22 are separated therebetween so as to elongate the air blowing path 24 (the windward side wind path 25), and the structure is made such that the steam absorption distance can be sufficiently secured.

The structure of the air blowing path 24 can be freely changed, and the steam generator can be freely provided in any of the outdoor and the indoor. Further, the humidifying system may be freely changed its structure to the other steam system than the illustrated one, an evaporation system, a water spray system and the like.

Identical codes are used to refer to parts identical to those of Embodiment 4, and detailed explanation thereof will be omitted.

(Embodiment 10)

Figure 28:
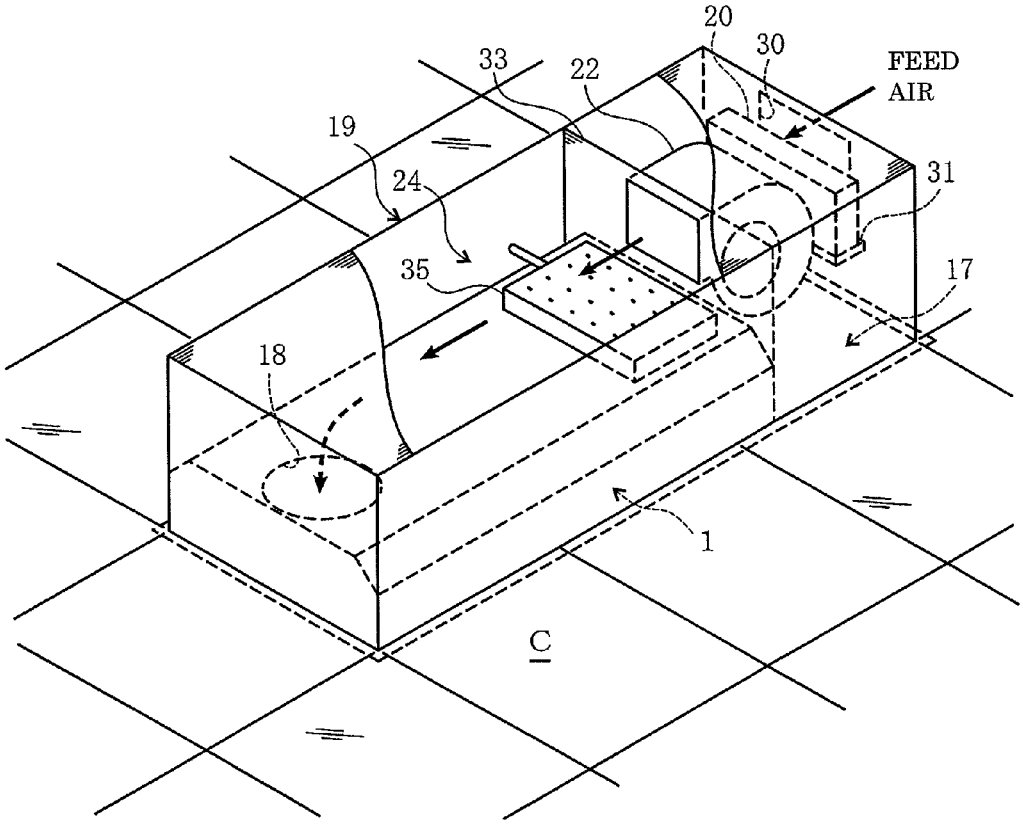
FIG. 28 is a perspective view of an induction emission air conditioning apparatus according to Embodiment 10 of the present invention wherein a part of an upper face of a casing is cut away, and viewed from the above.

FIG. 28 is a perspective view of an induction emission air conditioning apparatus according to Embodiment 10 of the Present invention wherein a part of an upper face of the casing 19 is cut away, and viewed from the above. The induction emission air conditioning apparatus according to Embodiment 10 is structured such that the duct-shaped member 34 is omitted from the induction emission air conditioning apparatus according to Embodiment 8.

More particularly, in the induction emission air conditioning apparatus according to Embodiment 10, the air blowing path 24 is widened by omitting the duct-shaped member 34, and the humidifier 35 is provided by utilizing the space. The humidifier 35 is provided in the vicinity of the fan 22, the air inlet 18 is provided so as to be spaced from the fan 22, and the structure is made such that the air blowing path 24 becomes longer. Accordingly, it is possible to sufficiently secure the steam absorption distance.

Further, the heat exchanger 20, the fan 22 and the induction port 30 are provided in any one of both ends of the heating and cooling unit 1. The structure of the air blowing path 24 is freely changed, and the other than the steam generator may be freely provided in any of the outdoor and the indoor. Further, the humidifying system may be freely changed its structure to the other steam system than the illustrated one, the evaporation system, the water spray system and the like. Since the other structures are the same as those of Embodiment 4, identical codes are used to refer to parts identical to those of Embodiment 4, and detailed explanation thereof will be omitted.

It is to be noted that the present invention is not limited to the embodiments mentioned above, but can be changed its design within the scope which does not deviate from the scope of the present invention. For example, the position or the number of the lighting system R and the panel 17 may be freely changed, and the number or the position of the detector 28 and the controller 29 may be freely changed, in each of the embodiments mentioned above. Further, the position of the induction port 30 may be freely changed, and the structure may be made such that the feed air can pass in the heat exchanger 20 by providing the induction port 30 in place of the lighting system R or the panel 17.

In Embodiment 8 and Embodiment 10, the lighting system R may be provided so as to be freely opened and closed or be detachable in place of any one panel 17, or the structure may be made such as the embodiment in FIG. 24 by omitting the panel 17.

Further, in each of the embodiments mentioned above, the casing 19 is buried in the back side of the ceiling C by exposing the lower face of the mixer case 16 to the room inside S, however, the structure may be made such that the entire apparatus is provided on the ceiling C so as to be exposed to the room inside S.

What is claimed is:

1. A heating and cooling unit comprising:

a mixer case for supplying mixed air, which is obtained by mixing circulated air from a space with feed air to be fed to the space;

an adjustment case for adjusting flow of the feed air to be fed to the mixer case;

a guide path, which is communicatively connected with the circulated air, for guiding the feed air to the mixer case;

a heat storage radiation member, which is attached in the mixer case in a thermally-conductive manner, for obtaining heat from the mixed air and radiating the heat to the space;

a plurality of juxtaposed flow dividing fins, which are formed in the heat storage radiation member, for dividing flow of mixed air to be supplied to the space and letting the mixed air through;

a box member, which has an opening at one face thereof and is provided such that the one face faces the space, for housing the adjustment case, the mixer case and the guide path; and a circulated air path, which is formed inside the box member and communicatively connecting the opening to the guide path, wherein the box member has a flat shape, the mixer case has a flat box shape and comprises an aperture face, which has an aperture where mixed air to be supplied to the space passes and faces the space, the circulated air path is formed at an outer side of one face opposed to the aperture face and at an outer side of any two opposed side faces adjacent to the aperture face, a rectangular air suction port for suctioning adjusted air from the adjustment case and the circulated air from the space is provided at a midpoint between the two opposed side faces on the one face of the mixer case, the adjustment case comprises a rectangular air blowoff port for blowing the adjusted air, and said air blowoff port is located to be matched with the air suction port of the mixer case.

2. The heating and cooling unit according to claim 1, wherein the heat storage radiation member comprises an elliptical heat storage pipe penetrating the plurality of flow dividing fins in a juxtaposition direction of the flow dividing fins.

3. The heating and cooling unit according to claim 2, wherein a heat storage member for obtaining heat from the mixed air and storing the heat is filled in the heat storage pipe.

4. The heating and cooling unit according to claim 1, further comprising a plurality of short tubular protrusions, which are formed to protrude from a face of the flow dividing fins, for changing a direction of radiation heating toward the space and dividing flow of the mixed air.

5. The heating and cooling unit according to claim 4, wherein the protrusions are juxtaposed in a longitudinal direction of the flow dividing fins so as to reach or almost reach adjacent flow dividing fins, the mixer case comprises an aperture face, which has an aperture where mixed air to be supplied to the space passes and faces the space, and the aperture is positioned below the protrusions.

6. The heating and cooling unit according to claim 5, wherein the aperture face of the mixer case has an area smaller than the opening of the box member, a passage clearance where circulated air to be suctioned into the circulated air path passes is formed between an edge of the opening of the box member and an edge of the aperture face, and a lighting system for lighting the room inside is provided at the passage clearance in a manner such that the circulated air can pass.

7. The heating and cooling unit according to claim 1, wherein the adjustment case is a box member which narrows toward the air blowoff port.

8. The heating and cooling unit according to claim 1, wherein the air blowoff port or the air suction port is constructed to be able to adjust a volume of air passing through.

9. The heating and cooling unit according to claim 8, wherein a pair of an air blowoff port door member and a pair of an air suction port door member for adjusting a volume of air to pass the air blowoff port or the air suction port are respectively attached to edge parts of both long sides of the air blowoff port or the air suction port so as to be slidable.

10. The heating and cooling unit according to claim 9, wherein the guide path includes a part of each of the air blowoff port door member and the air suction port door member, and the air blowoff port door member and the air suction port door member are located at opposed positions across a space.

11. The heating and cooling unit according to claim 1, wherein a guiding piece for guiding the feed air to the air blowoff port is provided inside the adjustment case.

12. The heating and cooling unit according to claim 1, wherein the adjustment case comprises: an inlet for receiving the feed air; and a suppression structure for suppressing occurrence of ununiformity in a wind pressure and a wind velocity of feed air in the adjustment case depending on a distance from the inlet.

13. The heating and cooling unit according to claim 12, wherein the suppression structure is a rectangular plate material, which is located to be opposed to the air blowoff port in a manner such that a distance from the air blowoff port gradually increases or decreases along a longitudinal direction of the air blowoff port, and the inlet is formed at one end side of the suppression structure, where the distance is the largest.

14. A heating and cooling unit comprising:

a mixer case for supplying mixed air, which is obtained by mixing circulated air from a space with feed air to be fed to the space;

a guide path, which is communicatively connected with the circulated air, for guiding the feed air to the mixer case;

a heat storage radiation member, which is attached in the mixer case in a thermally-conductive manner, for obtaining heat from the mixed air and radiating the heat to the space, the heat storage radiation member comprising a plurality of juxtaposed flow dividing fins for dividing flow of mixed air to be supplied to the space and letting the mixed air through; and a plurality of short tubular protrusions, which are formed to protrude from a face of the flow dividing fins, for changing a direction of radiation heating toward the space and dividing flow of the mixed air, the protrusions being juxtaposed in a longitudinal direction of the flow dividing fins so as to reach or almost reach adjacent flow dividing fins, the mixer case comprises an aperture face, which has an aperture where mixed air to be supplied to the space passes and faces the space, and the aperture is positioned below the protrusions, wherein the box member has a flat shape, the mixer case has a flat box shape, the circulated air path is formed at an outer side of one face opposed to the aperture face and at an outer side of any two opposed side faces adjacent to the aperture face, a rectangular air suction port for suctioning adjusted air from the adjustment case and circulated air from the space is provided at a midpoint between the two opposed side faces on the one face of the mixer case, the adjustment case comprises a rectangular air blowoff port for blowing the adjusted air, and said air blowoff port is located to be matched with the air suction port of the mixer case.

* * * * *